US012465817B2

(12) United States Patent
Mooney et al.

(10) Patent No.: US 12,465,817 B2
(45) Date of Patent: Nov. 11, 2025

(54) MULTI-MOTOR MODULE FOR A RESISTANCE TRAINING MACHINE, SYSTEMS, AND METHODS OF USE

(71) Applicant: Speede Fitness, LLC, Lake Zurich, IL (US)

(72) Inventors: Daniel Mooney, Lake Zurich, IL (US); Gregory Tepas, Barrington, IL (US)

(73) Assignee: Speede Fitness, LLC, Lake Zurich, IL (US)

( * ) Notice: Subject to any disclaimer, the term of this patent is extended or adjusted under 35 U.S.C. 154(b) by 0 days.

(21) Appl. No.: 18/985,295

(22) Filed: Dec. 18, 2024

(65) Prior Publication Data

US 2025/0195955 A1 Jun. 19, 2025

Related U.S. Application Data

(63) Continuation of application No. PCT/US2023/068958, filed on Jun. 23, 2023.

(60) Provisional application No. 63/354,800, filed on Jun. 23, 2022.

(51) Int. Cl.
*A63B 24/00* (2006.01)
*A63B 21/005* (2006.01)

(52) U.S. Cl.
CPC ..... *A63B 24/0087* (2013.01); *A63B 21/0058* (2013.01)

(58) Field of Classification Search
CPC ..... A63B 21/0058; A63B 21/002; A63B 21/0023; A63B 21/0059; A63B 2024/0093; A63B 24/00; A63B 24/0087
See application file for complete search history.

(56) References Cited

U.S. PATENT DOCUMENTS

| | | | | |
|---|---|---|---|---|
| 4,822,036 | A | 4/1989 | Dang | |
| 6,280,361 | B1 * | 8/2001 | Harvey | A63B 24/00 482/4 |
| 6,302,829 | B1 | 10/2001 | Schmidt | |
| 7,717,824 | B2 | 5/2010 | Pinto | |
| 7,874,957 | B2 | 1/2011 | Hurwitz et al. | |
| 8,118,710 | B2 | 2/2012 | Weinman et al. | |
| 8,475,338 | B2 | 7/2013 | Greenhill et al. | |
| 8,613,689 | B2 | 12/2013 | Dyer et al. | |
| 8,663,068 | B1 | 3/2014 | Dyer et al. | |
| 8,727,946 | B2 | 5/2014 | Greenhill et al. | |
| 8,827,870 | B2 | 9/2014 | Dyer et al. | |

(Continued)

FOREIGN PATENT DOCUMENTS

WO 2022103278 A1 5/2022

OTHER PUBLICATIONS

US 10,279,209 B2, 05/2019, Orady et al. (withdrawn)

(Continued)

*Primary Examiner* — Megan Anderson
*Assistant Examiner* — Jonathan A Dicuia
(74) *Attorney, Agent, or Firm* — J. Peter Paredes; Amin Wasserman Gurnani LLP

(57) ABSTRACT

Provided herein are Methods and Systems For a Multi-Motor module system for a Resistance Training Machine, comprising a training program module and a programming framework; wherein a motor system module sets a mode of a drive system and motor hardware is operably coupled to an actuator to shift the drive system from a lower gear to a higher gear.

7 Claims, 14 Drawing Sheets

(56) References Cited

U.S. PATENT DOCUMENTS

| | | | | |
|---|---|---|---|---|
| 8,911,328 | B2 | 12/2014 | Alessandri et al. | |
| 9,061,170 | B2 | 6/2015 | Alessandri et al. | |
| 9,095,492 | B2 | 8/2015 | Verkaaik et al. | |
| 9,403,047 | B2 | 8/2016 | Olson et al. | |
| 9,409,053 | B1 | 8/2016 | Todd | |
| 9,474,935 | B2 | 10/2016 | Abbondanza et al. | |
| 9,539,458 | B1 * | 1/2017 | Ross | A63B 21/4043 |
| 9,636,543 | B2 | 5/2017 | Dyer et al. | |
| 9,757,605 | B2 | 9/2017 | Olson et al. | |
| 9,821,191 | B2 | 11/2017 | Abbondanza et al. | |
| 9,968,816 | B2 | 5/2018 | Olson et al. | |
| 10,099,085 | B2 | 10/2018 | Skinner et al. | |
| 10,118,073 | B2 | 11/2018 | Wicks et al. | |
| 10,188,890 | B2 | 1/2019 | Olson et al. | |
| 10,265,567 | B2 | 4/2019 | Wilt | |
| 10,335,626 | B2 | 7/2019 | Orady et al. | |
| 10,589,163 | B2 | 3/2020 | Orady et al. | |
| 10,617,904 | B2 | 4/2020 | Chiavegato et al. | |
| 10,758,767 | B2 | 9/2020 | Olson et al. | |
| 10,765,914 | B1 | 9/2020 | Trexler | |
| 10,792,539 | B1 | 10/2020 | Gilstrom et al. | |
| 10,814,172 | B1 | 10/2020 | Ilfrey et al. | |
| 10,821,323 | B2 | 11/2020 | Abbondanza et al. | |
| 10,828,531 | B1 | 11/2020 | Smith et al. | |
| 10,850,162 | B2 | 12/2020 | Wicks et al. | |
| 10,881,890 | B2 | 1/2021 | Orady et al. | |
| 10,960,266 | B2 | 3/2021 | Messinger | |
| 10,967,214 | B1 | 4/2021 | Olson et al. | |
| 10,987,538 | B2 | 4/2021 | Fowler | |
| 11,040,231 | B2 | 6/2021 | Rubin et al. | |
| 11,052,279 | B1 | 7/2021 | Vujicic et al. | |
| 11,077,330 | B2 | 8/2021 | Orady et al. | |
| 11,123,592 | B2 | 9/2021 | Orady et al. | |
| 11,123,609 | B2 | 9/2021 | Rubin et al. | |
| 11,161,004 | B2 | 11/2021 | Lee | |
| 11,161,012 | B1 | 11/2021 | Hendricks et al. | |
| 12,115,417 | B2 * | 10/2024 | Norris | A63B 24/0087 |
| 12,151,135 | B2 * | 11/2024 | Premachandra | A63B 71/0054 |
| 2002/0025888 | A1 | 2/2002 | Germanton et al. | |
| 2007/0249468 | A1 | 10/2007 | Chen | |
| 2011/0152045 | A1 | 6/2011 | Horne | |
| 2014/0315688 | A1 | 10/2014 | Weinman et al. | |
| 2017/0319941 | A1 | 11/2017 | Smith et al. | |
| 2018/0021616 | A1 * | 1/2018 | Orady | A63B 21/16 482/5 |
| 2018/0339195 | A1 | 11/2018 | Bernotas | |
| 2019/0046830 | A1 | 2/2019 | Chiavegato et al. | |
| 2019/0160321 | A1 * | 5/2019 | Ozsecen | A63B 24/0087 |
| 2020/0254295 | A1 | 8/2020 | Watterson | |
| 2020/0342975 | A1 | 10/2020 | Bengtsson et al. | |
| 2020/0391069 | A1 | 12/2020 | Olson et al. | |
| 2020/0391080 | A1 | 12/2020 | Powers et al. | |
| 2021/0008401 | A1 | 1/2021 | Orady et al. | |
| 2021/0060378 | A1 | 3/2021 | Smith et al. | |
| 2021/0128978 | A1 | 5/2021 | Gilstrom et al. | |
| 2021/0154531 | A1 | 5/2021 | Gilstrom et al. | |
| 2023/0226413 | A1 * | 7/2023 | Neuhaus | A63B 71/0622 482/5 |

OTHER PUBLICATIONS

WIPO/ISA/US, International Search Report and Written Opinion for corresponding application PCT/US2023/068958, dated Dec. 11, 2023, 13 pages.

* cited by examiner

MULTI-MOTOR MODULE FOR A RESISTANCE TRAINING MACHINE, SYSTEMS, AND METHODS OF USE

CROSS-REFERENCE TO RELATED APPLICATIONS

The present application claims priority to PCT application serial no. PCT/US2023/068958, filed Jun. 23, 2023, which claims priority to U.S. provisional application Ser. No. 63/354,800, filed Jun. 23, 2022, each herein incorporated by references in their entireties.

BACKGROUND

The invention generally relates to methods and systems for controlling a resistance training machine.

Resistance training is a form of exercise undergone to build muscular strength and endurance by working against a weight or applied force. While some resistance training routines can be accomplished without external equipment, i.e., bodyweight exercises, many others require the use of specialized equipment, such as but not limited to free weights, weight machines, cable machines, resistance bands, and the like.

Traditional resistance training equipment is often specialized and, while each piece of equipment may offer distinct advantages, each may also suffer from drawbacks and inefficiencies. For example, free weights and weight machines are commonly employed for isotonic exercises, i.e., exercises requiring muscle activation against a constant force across a given range of motion. However, adjusting the weight or force for such exercises can be inconvenient, often requiring a user to add or remove plates, install clips, swap out dumbbells, etc. Furthermore, initiating an exercise with free weights and weight machines can create undue strain on a user's body, since the force applied by such equipment acts as a step function-jumping from zero to the full resistance. Perhaps more importantly, traditional resistance training equipment is usually designed for specific exercises or specific exercise modes only, requiring an individual to own a plurality of equipment in order to access a variety of well-rounded exercises.

More recently, 'smart' exercise machines have been developed that claim to offer a number of different exercises in a single machine. These machines commonly operate by providing resistive forces through electronic motors, which may be adjusted to the user's strength level. However, the exercise machines disclosed by the prior art have consistently failed to provide a range of exercise modes or can provide some modes but fail in others. Moreover, such machines tend to be limited in the amount of force they produce; they are usually unwieldy and difficult to install or transport; and many fail to provide adequate safety measures for the user. Finally, neither traditional resistance training equipment nor newer exercise machines offer feedback regarding both user form and user balance during workouts.

Accordingly, there remains a need in the art for software to control a resistance training machine that is capable of implementing a large number of exercise modes, including at least isotonic and isokinetic exercises; that is capable of supplying high levels of resistive force; and that may provide feedback on user form and user balance throughout each exercise.

SUMMARY OF THE INVENTION

Provided herein are Multi-Motor Module for a Resistance Training Machines, Systems, and Methods of Use.

The methods, systems, and apparatuses are set forth in part in the description which follows, and in part will be obvious from the description, or can be learned by practice of the methods, apparatuses, and systems. The advantages of the methods, apparatuses, and systems will be realized and attained by means of the elements and combinations particularly pointed out in the appended claims. It is to be understood that both the foregoing general description and the following detailed description are exemplary and explanatory only and are not restrictive of the methods, apparatuses, and systems, as claimed.

Accordingly, it is an object of the invention not to encompass within the invention any previously known product, process of making the product, or method of using the product such that Applicants reserve the right and hereby disclose a disclaimer of any previously known product, process, or method. It is further noted that the invention does not intend to encompass within the scope of the invention any product, process, or making of the product or method of using the product, which does not meet the written description and enablement requirements of the USPTO (35 U.S.C. § 112, first paragraph) or the EPO (Article 83 of the EPC), such that Applicants reserve the right and hereby disclose a disclaimer of any previously described product, process of making the product, or method of using the product. It may be advantageous in the practice of the invention to be in compliance with Art. 53(c) EPC and Rule 28(b) and (c) EPC. All rights to explicitly disclaim any embodiments that are the subject of any granted patent(s) of applicant in the lineage of this application or in any other lineage or in any prior filed application of any third party is explicitly reserved. Nothing herein is to be construed as a promise.

BRIEF DESCRIPTION OF THE DRAWINGS

In the accompanying figures, like elements are identified by like reference numerals among the several preferred embodiments of the present invention.

DETAILED DESCRIPTION OF THE INVENTION

Figure 1:
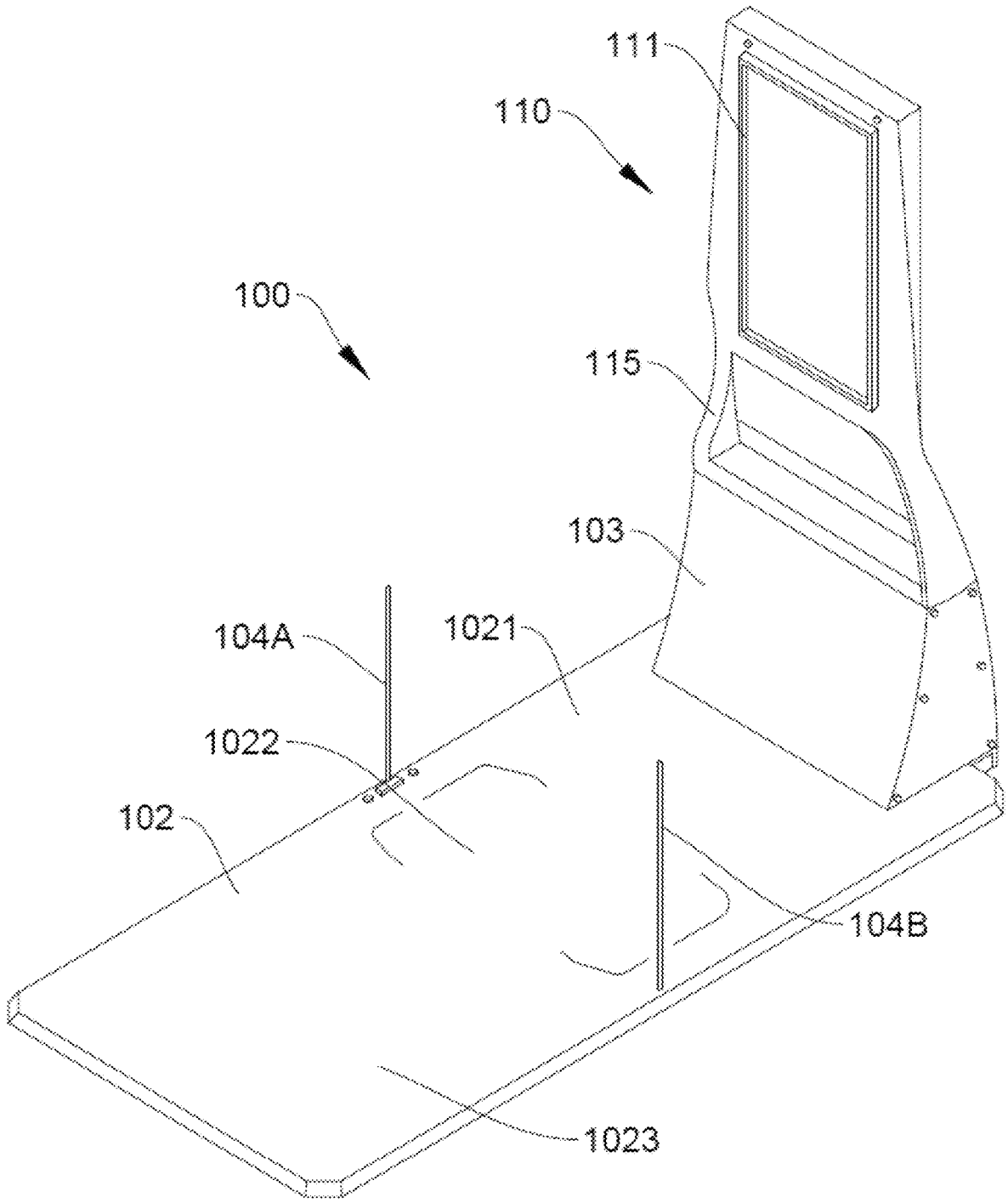
FIG. 1 is a perspective view of the multi-motor resistance training machine, according to one embodiment.

The foregoing and other features and advantages of the invention are apparent from the following detailed description of exemplary embodiments, read in conjunction with the accompanying drawings. The detailed description and drawings are merely illustrative of the invention rather than limiting, the scope of the invention being defined by the appended claims and equivalents thereof.

Embodiments of the invention will now be described with reference to the Figures, wherein like numerals reflect like elements throughout. The terminology used in the description presented herein is not intended to be interpreted in any limited or restrictive way, simply because it is being utilized in conjunction with detailed description of certain specific embodiments of the invention. Furthermore, embodiments of the invention may include several novel features, no single one of which is solely responsible for its desirable attributes, or which is essential to practicing the invention described herein.

The use of the terms "a" and "an" and "the" and similar referents in the context of describing the invention are to be construed to cover both the singular and the plural, unless otherwise indicated herein or clearly contradicted by context. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

Recitation of ranges of values herein are merely intended to serve as a shorthand method of referring individually to each separate value falling within the range, unless otherwise indicated herein, and each separate value is incorporated into the specification as if it were individually recited herein. The word "about," when accompanying a numerical value, is to be construed as indicating a deviation of up to and inclusive of 10% from the stated numerical value. The use of any and all examples, or exemplary language ("e.g.," or "such as") provided herein, is intended merely to better illuminate the invention and does not pose a limitation on the scope of the invention unless otherwise claimed. No language in the specification should be construed as indicating any nonclaimed element as essential to the practice of the invention.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

As used herein the term "method" refers to manners, means, techniques and procedures for accomplishing a given task including, but not limited to, those manners, means, techniques and procedures either known to, or readily developed from known manners, means, techniques and procedures by practitioners of the mechanical, software, and electrical arts. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Description of Embodiments

Figure 2A:
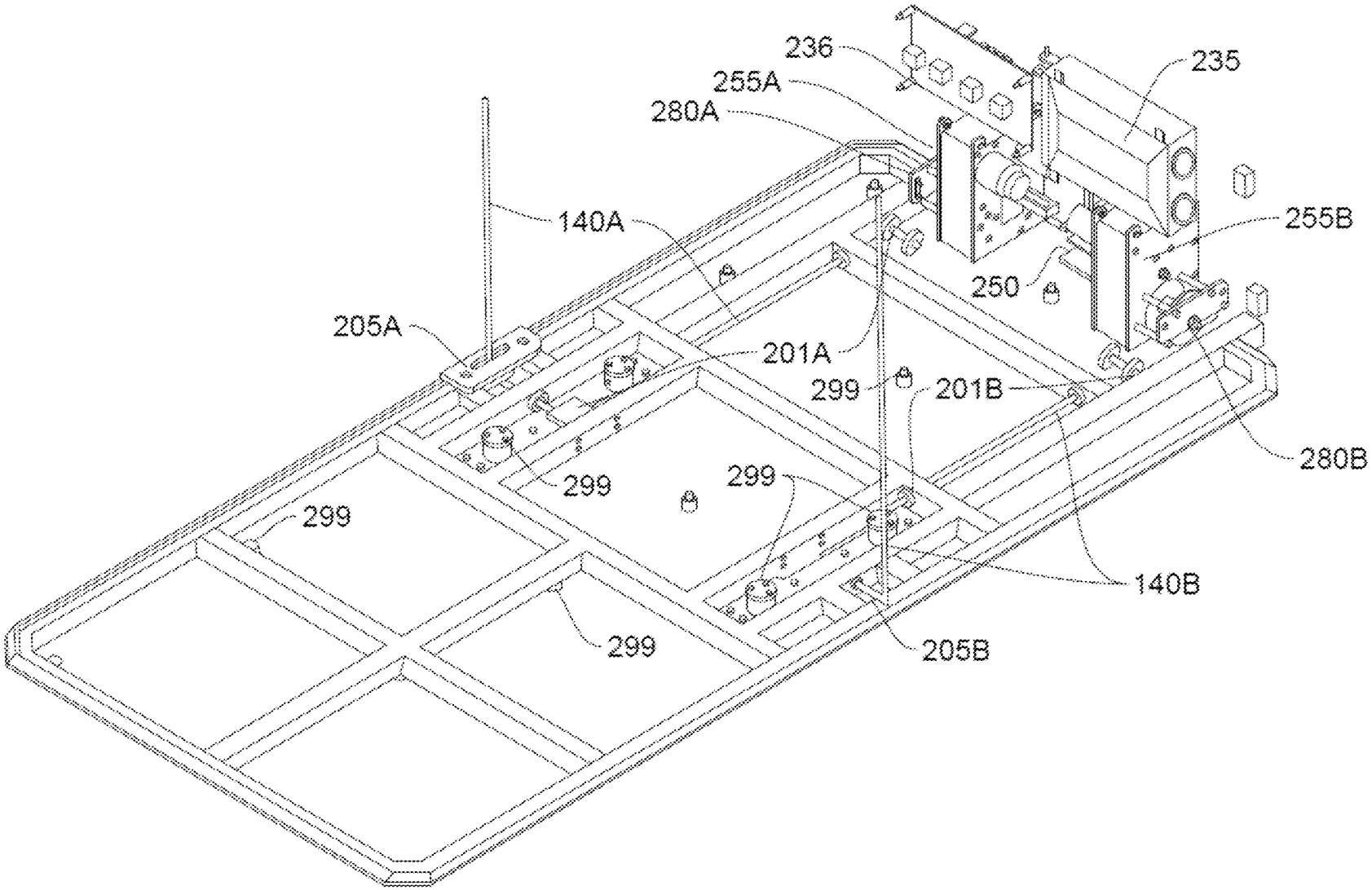
FIG. 2A is a cut-away perspective view of the multi-motor resistance training machine, according to one embodiment.
Figure 2C:
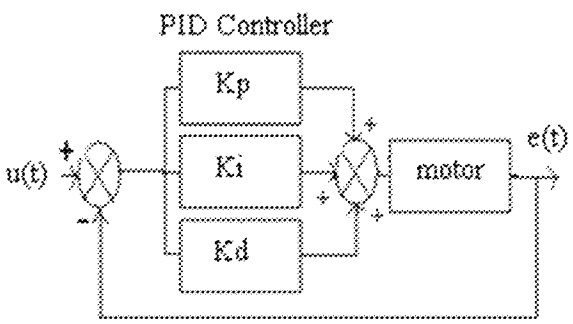
FIG. 2B is a schematic flow chart of the motor system module, according to one embodiment; 2C is a schematic of the PID loop, according to one embodiment.

Referring now to the drawings and with specific reference to FIG. 1, a diagram of a multi-motor resistance training machine is generally referred to by a reference numeral 100 and may be generally referred to as machine or resistance training machine. The multi-motor resistance training machine 100 may be situated in a home, apartment, hotel, commercial gym, and the like, and may be capable of enabling both isotonic exercises and isokinetic exercises at varying force and velocity levels, respectively, for a user. Furthermore, the resistance training machine may measure and communicate form feedback, force feedback, velocity feedback, position feedback, calibration feedback, and balance feedback during some or all exercises performed on the machine 100, thereby improving workout efficacy and safety for the user. As seen in FIGS. 1-2A, the multi-motor machine 100 may comprise at least a platform 102, a left cable 140A, a right cable 140B, and a human-machine interface (HMI) 110 to select one or more exercise modes. The resistance training machine 100 may comprise the platform 102 for a user to stand on and engage in exercises, wherein the platform may include a front section 1021, a middle section 1022, and a rear section 1023. An electromagnetic assembly (EM) 103 may be attached to the front section 1021, and a front upright stand 115 may be attached to and extend vertically from the EM assembly 103 to display the HMI 110. The EM assembly 103 operates with multi-motors to provide resistance training for isotonic exercises and isokinetic exercises in a plurality of modes. The multi-motors work together to provide left and right movements on the resistance training machine, where the multi-motors work in parallel with a speed gear box to employ a low force and a high speed work out and a slower speed but a high force work out.

Motor System Module

Figure 2B:
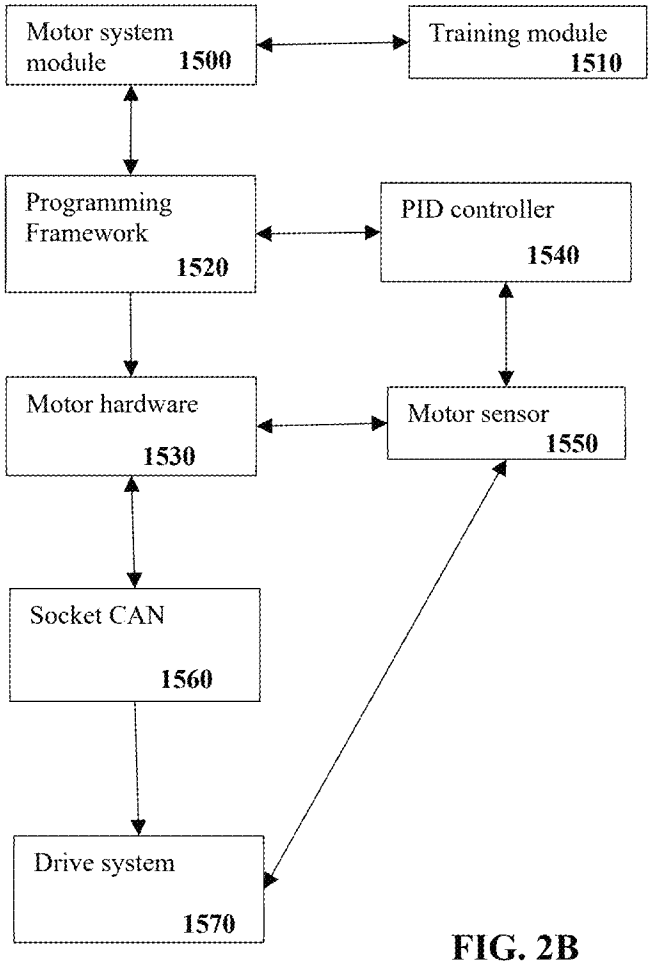

As shown in FIG. 2B, the motor system module 1500 comprises a training program module 1510 and a programming framework 1520. The motor system module 1500 sets the mode of the drive system 1570, whether the isokinetic mode or the isotonic mode at varying velocity and force levels, respectively. In one embodiment, the motor system module 1500 sets and removes the force for both the right and left motor systems and operates the first motor and the second motor in the left drive system and the third and fourth motor in the right motor system in parallel. In another embodiment, motor system module 1500 sets and removes the force for both the right and left motor systems and operates the first motor in the left drive system and the second motor in the right motor system in parallel. The motor system module 1500 may also set and remove the target velocity for the right and left motor system. Upon receiving such a command, the motor system module 1500 may be capable of independently maintaining the commanded velocity through internal control mechanisms without the need for additional signals from a machine controller or from external encoders. The above notwithstanding, in some embodiments, the motor system 1500 may also receive external feedback from the machine controller and/or from external encoders to supplement its internal control mechanisms. The motor system module 1500 may receive input/feedback from a wireless button for control, start/stop, and calibration, as indicated below.

In one embodiment, the training program module 1510 removes break/stop of the motor system and sets proper actuator position. The training program module 1540 sends the start calibration mode or sets the movement data from a previous calibration, where the motor system module tracks the encoder and not allow the user to pull out more cable by placing the brake at the proper max/min. If calibration is needed, the motor drive module looks for the tension on the cables and if the user is resisting the cable, the drive system should stop pulling the cable in. The user then presses the sensor once it is at the right stop.

The motor system module 1500 sets and checks the target distance for each repetition on the exercise machine. The motor system module 1500 provides or receives the data from the motor sensors or wireless sensors 1550. Data from each of the first motor, the second motor, the third motor, and the fourth motor may be collected, stored, and sent upon request from the motor system module 1500. The programming framework 1520 is operably coupled and communicable to the motor hardware 1530 and a socket CAN 1560. The programming framework controls the motor hardware 1530 contained in the drive system 1570 by a PID controller 1540. The motor hardware 1530 may be operably coupled to an actuator to shift the drive system 1570 from a lower gear to a higher gear and vice versa. In one embodiment, the low gear is between about 1.6:1 and about 4.8:1 and the high gear is between about 22:1 to about 66:1. The isokinetic mode sets the drive system 1570 to the higher gear and the isotonic mode sets the drive system 1570 to the lower gear. In other embodiments, the low gear is between about 1.1:1.0 and about 6.0:1.0 and the high gear is between about 10.0:1 and about 70.0:1.

The socket CAN 1560 is an implementation of CAN protocols (Controller Area Network) for Linux, according to one embodiment. CAN is a networking technology and Socket CAN uses the Berkeley socket API, the Linux network stack and implements the CAN device drivers as network interfaces. The CAN socket includes an API, in one embodiment. In one embodiment, the programming framework 1520 employs Phoenix SDX, which is a package that targets Lab VIEW, C++, and Java for a Robotics Controller platform. Phoenix SDX includes the Application Programming Interface (API), which are the functions to be manipulated on the CAN bus.

The programming framework 1520 comprises an independently implementing closed-loop Proportional-Integral-Derivative (PID) controller 1540 that is capable of independently tuning the drive system 1570 to operate at a constant current, operate at a constant position, operate at a constant velocity, and/or implement a specific motion profile. The motor system module 1500 moves the cable and provides tension by a control loop. The motor system module 1500 may apply a stop value, a start value, current value or a speed value, depending on isotonic or isokinetic mode applied. The PID values instructions the motor on how smooth the motor will pull the cable and how much current will be applied to the motor to pull the cable or provide tension on the cable or a counter force. In the same or other embodiments, the motor system module 1500 may operatively supply instructions to the drive system 1570 with respect to the above parameters through a CAN bus, PWM signal, or similar protocol common to the art. When the exercise machine is off, the motor system module 1500 applies a brake or stop value to the right and left motor systems.

Proportional-Integral-Derivative (PID) controller 1540 continuously calculates an error value e (t) as the difference between a desired setpoint (SP) and a measured process variable (PV) and applies a correction based on proportional, integral, and derivative terms (denoted P, I, and D respectively). PID automatically applies an accurate and responsive correction to a control function. The controller's PID algorithm restores the measured speed to the desired speed with minimal delay and overshoot by increasing the current output of the motor in a controlled manner. The PID controller 1540 updates all closed-loop modes every 1 ms (1000 Hz)

In one embodiment, the difference between the PV and SP is the error (e), which quantifies whether the current value or speed value is too low or too high and by how much. The input to the process (the electric current in the motor) is the output from the PID controller, which is either the manipulated variable (MV) or the control variable (CV). By measuring the position (PV), and subtracting it from the setpoint (SP), the error (e) is found, and from it the controller calculates how much electric current to supply to the motor (MV).

The parameters of the PID controller Kp, Ki, Kd can be manipulated to produce various response Curves from a given process. The constant Kp, Ki, Kd values are set by using resistor and capacitor and may be replaced by microcontrollers, which has the benefit of integrating large amounts of code in a single IC. These circuits and PID controller are prepared and tested for the motor, generally shown in FIG. 2C, and the Kp, Ki, Kd values are tuned for the isotonic and the isokinetic modes. While tuning the closed-loop, a tuner configuration may quickly change the gains between about 0.001 seconds and about 0.1 seconds. Once the PID loop is stable, the gain values are set in code. There are different tuning methods used to tune PID controller such as Ziegler-Nichol's method, manual tuning method and MATLAB tuning method.

In one embodiment, PID controller will pull closed-loop gain/setting information from a selected slot, where there are four slots to choose from for gain-scheduling, kF, kP, kI, and kD. The PID controller loop may be used for a velocity closed-loop, a current closed-loop, or a Velocity Feed Forward gain (kF). kF is the Feed Fwd gain for Closed loop. kP is the Proportional gain for closed loop, which is multiplied by closed loop error in sensor units. kI is the Integral gain for closed loop, which is multiplied by closed loop error in sensor units every PID Loop. kD is the Derivative gain for closed loop, which is multiplied by derivative error (sensor units per PID loop).

FIG. 2A, a cut-away schematic of the platform 102 of the resistance training machine 100 is provided. In particular, the resistance training machine 100 may comprise a power supply 235, a power distribution board 236, a left motor assembly 255A, a right motor assembly 255B, a left pulley system 201A, a right pulley system 201B, a left cable 140A, a right cable 140B, a machine controller 250, and one or more load cells 299. Given the mirrored nature of the left elements and the right elements in many embodiments, for the ease of clarity, the descriptors "left" and "right" may be foregone if not specially indicated by a designator "A" after the reference numeral for "left" and designator "B" after the reference numeral for "right". Accordingly, the following description may be applied to either or both the left and right elements of the resistance training machine 100. While each of the above components are located within the EM assembly 103 in FIG. 2A, in other embodiments, some or all of the above components may be placed elsewhere in the machine 100. For example, each of the power supply 235, motors 255, and machine controller 250 may be located in the platform 102, and the pulley systems 201 may be located in both the EM assembly 103 and the platform 102. No limitation is intended herein for the precise placement of the components of the machine 100, which may include any combination of locations in the platform 102, EM assembly 103, and front upright stand 115.

The power supply 235 may receive electrical power from an external supply and may provide electrical power to some or all of the other electronic components of the machine 100, where wattage ratings may be determined by specific application requirements. In some embodiments, such as the one shown in FIG. 2A, each of the aforementioned motors, pulley systems, and cables may be substantially mirrored across a central plane (defined by the Y-axis and Z-axis) of the machine 100. In other embodiments, however, the left elements and the right elements may necessarily be symmetrical, and may be offset with respect to the X-axis, Y-axis, or Z-axis, depending on specific application requirements. Regardless, for ease of clarity, the following discussion with respect to the right elements of the machine 100 may be analogously applied to their left counterparts, and vice versa.

As seen in FIG. 2A, the right pulley system 201B may be configured to operatively convert a torque outputted by the right motor system 255B to a vertical (Z-axis) force vector, i.e., a force vector having a non-zero vertical (Z-axis) component. Associated with the right pulley system 201B is the right cable 140B, which may be operatively, but not necessarily directly, coupled to the right motor 255B at a first end, and which may run through the right pulley system 201B. In other words, a torque generated by the right motor 255B may be operatively converted into tension in the right cable 140B through the right pulley system 201B at the second end of the right cable 140B. As previously discussed, an analogous configuration may be applied to the left motor system 255A, left pulley system 201A, and left cable 140A. The cables 140A, 140B may be fixed to the drum pulley 280A, 280B at a first end and configured to wind and unwind from the drum pulleys 280A, 280B as it is retracted and extended, respectively. More specifically, the cables 140A, 140B may begin at the drum pulleys 280A, 280B, extend through the one or more cable pulleys, and exit vertically through the pulley housing 205A, 205B. The cables 140A, 140B exert a force countered by the left motor 255A and right motor 255B, respectively. In some embodiments, the pulley housing 205 may be located on an outer perimeter of the platform 102, wherein a left pulley housing 205A and a right pulley housing 205B may be appropriately mirrored across the platform 102. In other embodiments, however, the pulley housing 205 and the termination of the cable 140 may be located in other sections of the platform 102, may be symmetrical across a different plane of the platform 102, or may not be symmetrical at all. No limitation is intended herein for the number of elements included in each pulley system 201, which may include elements designed to change a direction of travel for the cable 140, stabilize the cable 140, manage reactive forces, and even perform force multiplication. In one embodiment, the right pulley housing 205B and the left pulley housing 205A includes a sensor to measure the tension on the right and left cable, respectively. The pulley housing sensor measures tension to send feedback to the motors if the motors stop or slow down below a threshold and prevent the cables from being tangled or wrapped around any part of the pulley systems. Finally, the right pulley system 201B and the left pulley system 201A may be configured and behave analogously and may or may not be symmetrical with its right counterpart.

Returning now to FIG. 2A, in some embodiments, the machine 100 may further comprise a plurality of load cells 299 located inside the platform 102. Each load cell 299 may be, without limitation, a single point load cell, digital load cell, beam load cell, canister load cell, pressure sensor, force sensor, force plates, a zero ball sensor, transducers, and the like, and may operatively measure a force, force distribution, weight and/or weight distribution of a user working out on top of the platform 102. In the embodiment shown, the machine 100 may specifically comprise at least load cells 299 spaced evenly across the middle section 1022 of the platform 102, although other quantities and distributions are also possible in the front section 1021 and the back section 1023. As shown in FIG. 2, the load cells 299 may specifically be placed in the middle section 1022, the front section 1021, and the back section 1023 of the platform 102. Appropriate markings may further be included on a surface of the platform 102 to indicate the position of the load cells 299 and/or a preferred standing position for the user.

Figure 3A:
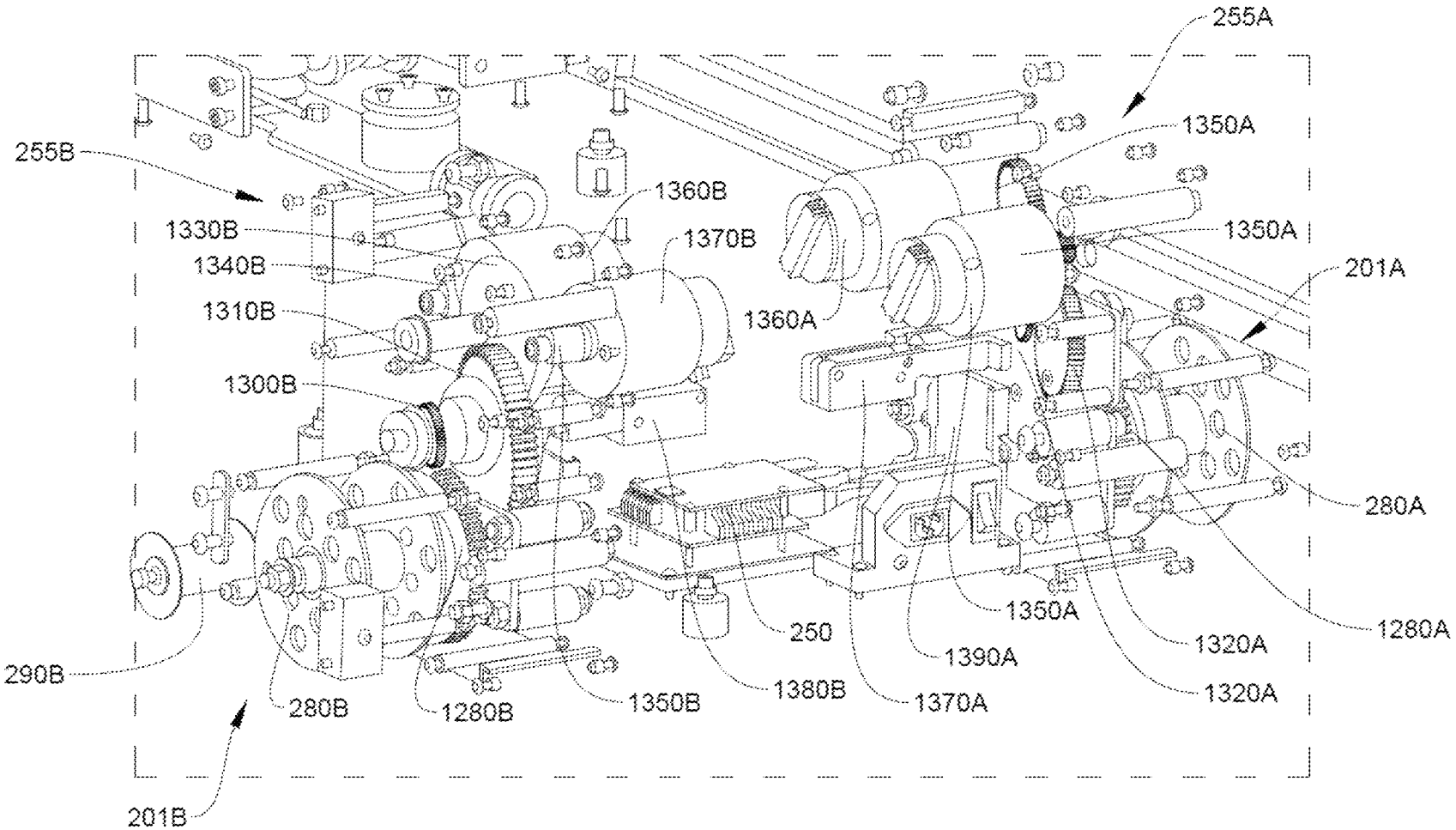
FIG. 3A is a cut-away perspective view of the motor systems, according to one embodiment.
Figure 3B:
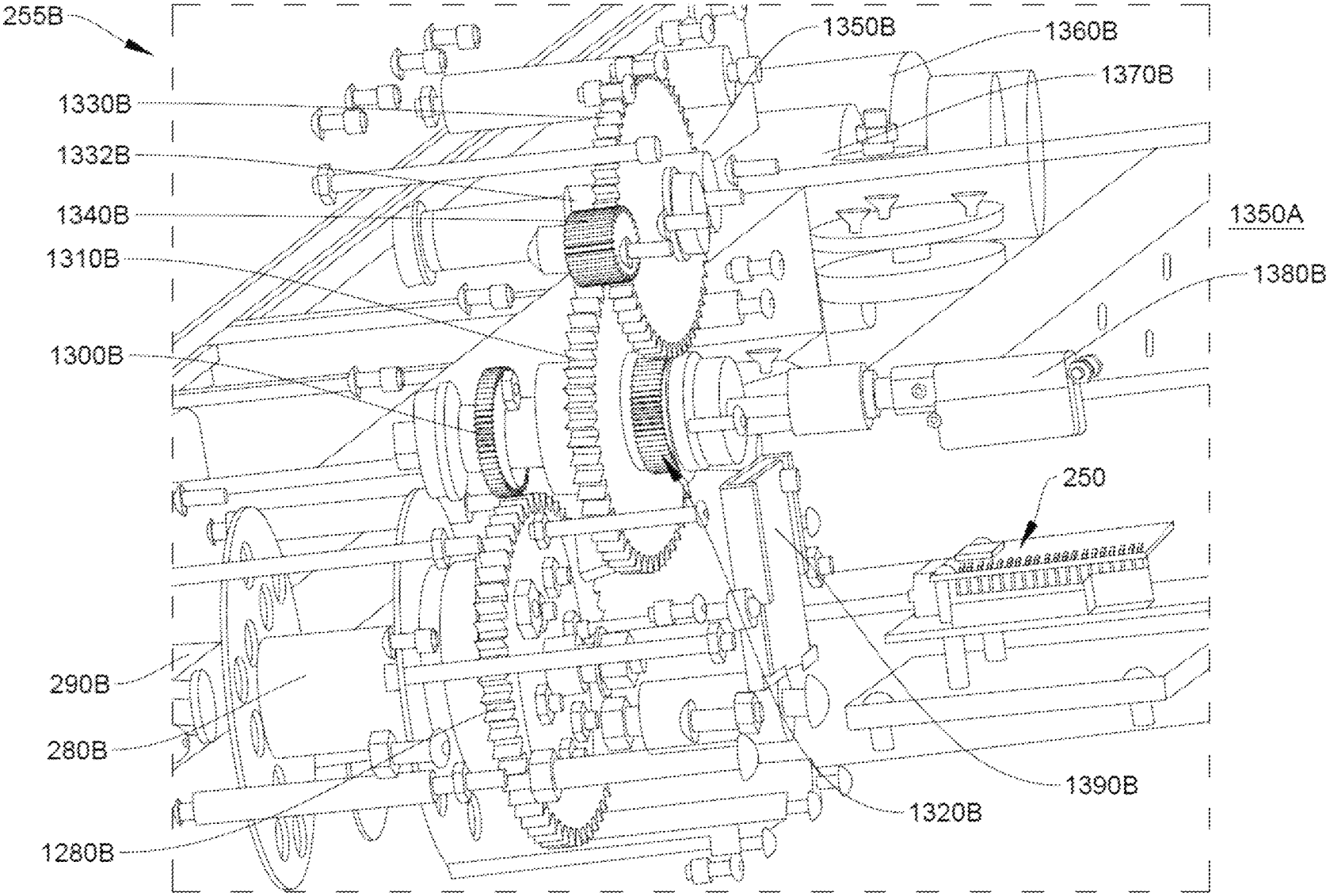
FIG. 3B is a cut-away enlarged view of the right motor system, according to one embodiment.

As shown in FIG. 3A, the right pulley system 201B and the left pulley system 201A is operably coupled to a right motor system 255B and a left motor system 255A, respectively. The right motor system 255B is operably coupled to the right drum pulley 280B, one or more right cable pulleys 290B, and a right drum gear 1280B. The right drum gear 1280B is rotatably coupled to a right spur gear 1300B. The right spur gear 1300B is rotated by a right larger spur gear 1310B. As shown in FIG. 3B, the right larger spur gear 1310B is rotated by a right smaller gear 1320B. The right smaller gear 1320B is rotatably coupled to a right larger gear 1330B and the right larger gear 1330B is rotatably coupled to a right smaller spur gear 1332B. The right larger gear 1330B is rotatably coupled to a first right coupler gear 1340B and a second right coupler gear 1350B. The rotation of the first right coupler gear 1340B is driven by a first right motor 1360B and the rotation of the second right coupler gear 1350B is driven by a second right motor 1370B. The right smaller gear 1320B is operably coupled to a right linear actuator 1380B, which switches the right smaller gear 1320B to a higher gear in the isokinetic mode and switches the right smaller gear 1320B to a lower gear in the isotonic mode or calibration mode. The higher gear forces the first right motor 1360B and the second right motor 1370B to achieve a higher force and slower speed on the right cable, while the lower gear forces the first right motor 1360B and the second right motor 1370B to achieve a lower resistive force on the cable allowing for a higher speed of the right cable. In one embodiment, the gear ratio of the lower gear to the higher gear is 1:16, 1:15, 1:14, 1:13, 1:12, 1:11, 1:10, 1:9, 1:8, 1:7, 1:6, 1:5, 1:4, 1;3, 1:2, or 1:1. While two motors are shown with the right motor system 255B, the right motor system 255B may feature any number of modular and interchangeable gear stages when adding additional motors to the right motor system and the left motor system, such as three motor, four motors, five motors, and the like. Without limitation, the motor systems 255 may further include any number of coupling components required to integrate additional motors and their shaft to the gears with the pulley system 201. The first right motor 1360B and the second right motor 1370B achieve a resistive force of at least about 100 to about 500 lbs. The right linear actuator 1380B is operably controlled by the right linear actuator control board 1390B.

The right linear actuator control board 1390B is operably coupled to the machine controller 250. The right motor system 255B and the left motor system 255A work in parallel and are controlled by the machine controller 250.

Figure 3C:
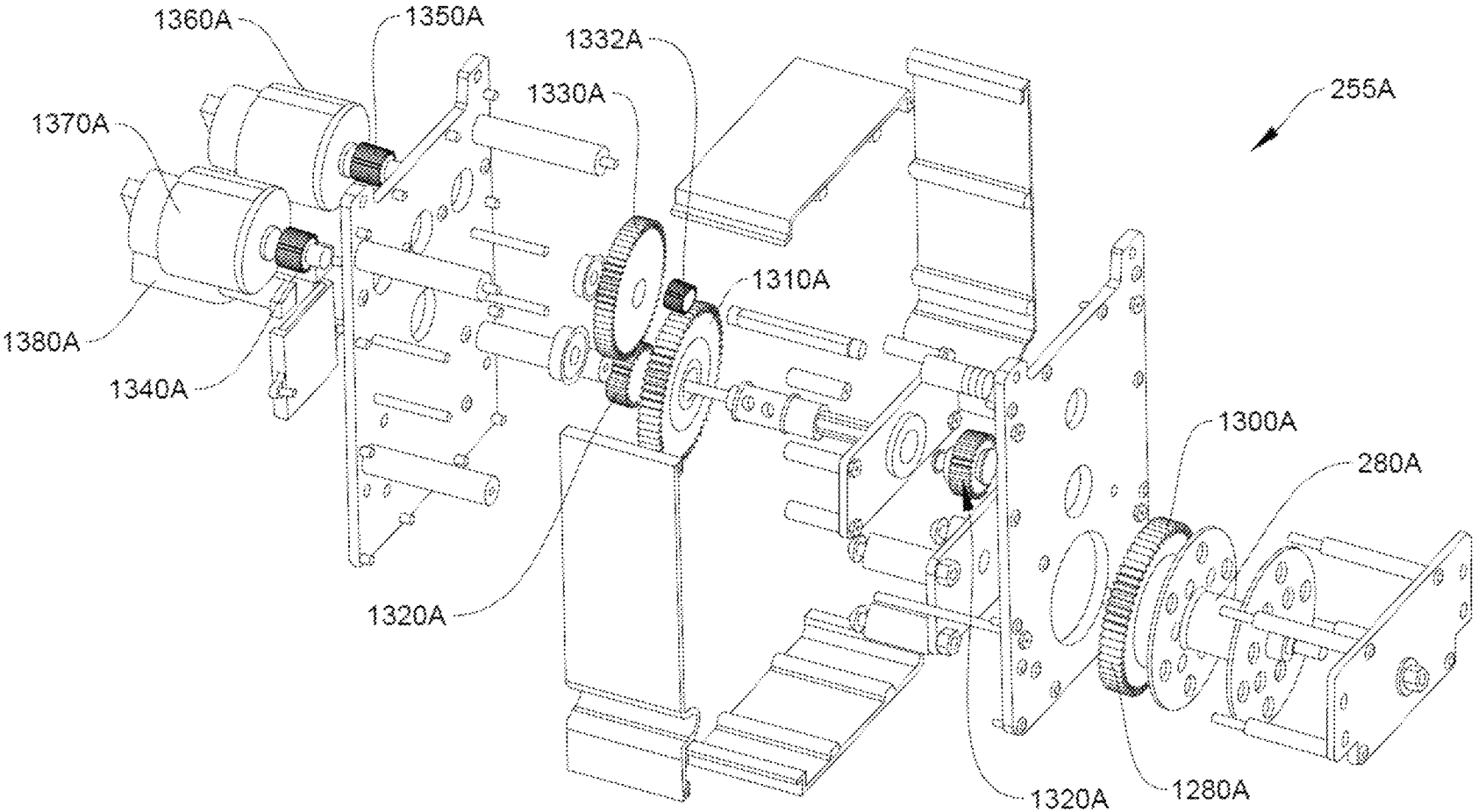
FIG. 3C is an exploded enlarged view of the left motor system, according to one embodiment.

As shown in FIG. 3C, the left pulley system 201A is operably coupled to the left motor system 255A. The left motor system 255A is operably coupled to the left drum pulley 280A, one or more left cable pulleys, and a left drum gear 1280A. The left drum gear 1280A is rotatably coupled to a left spur gear 1300A. The left spur gear 1300A is rotated by a left larger spur gear 1310A. The left larger spur gear 1310A is rotated by a left smaller gear 1320A. The left smaller gear 1320A is rotatably coupled to a left larger gear 1330A and the left larger gear 1330A is rotatably coupled to a left smaller spur gear 1332A. The left larger gear 1330A is rotatably coupled to a first left coupler gear 1340A and a second left coupler gear 1350A. The rotation of the first left coupler gear 1340A is driven by a first left motor 1360A and the rotation of the second left coupler gear 1350A is driven by a second left motor 1370A. The left smaller gear 1320A is operably coupled to a left linear actuator 1380A, which switches the left smaller gear 1320A to a higher gear in the isokinetic mode and switches the left smaller gear 1320A to a lower gear in the isotonic mode or calibration mode. The higher gear forces the first left motor 1360A and the second left motor 1370A to achieve a higher force and slower speed on the left cable, while the lower gear forces the first left motor 1360A and the second left motor 1370A to achieve a lower resistive force on the cable allowing for a higher speed of the left cable. In one embodiment, the gear ratio of the lower gear to the higher gear is 1:16, 1:15, 1:14, 1:13, 1:12, 1:11, 1:10, 1:9, 1:8, 1:7, 1:6, 1:5, 1:4, 1;3, 1:2, or 1:1. While two motors are shown with the left motor system 255A, the left motor system 255A may feature any number of modular and interchangeable gear stages when adding additional motors to the left motor system and the left motor system, such as three motor, four motors, five motors, and the like. Without limitation, the motor systems 255 may further include any number of coupling components required to integrate additional motors and their shaft to the gears with the pulley system 201. The first left motor 1360B and the second left motor 1370B achieve a resistive force of at least about 100 to about 500 lbs. The left linear actuator 1380B is operably controlled by the left linear actuator control board 1390A. The left linear actuator control board 1390B is operably coupled to the machine controller 250.

Figure 3D:
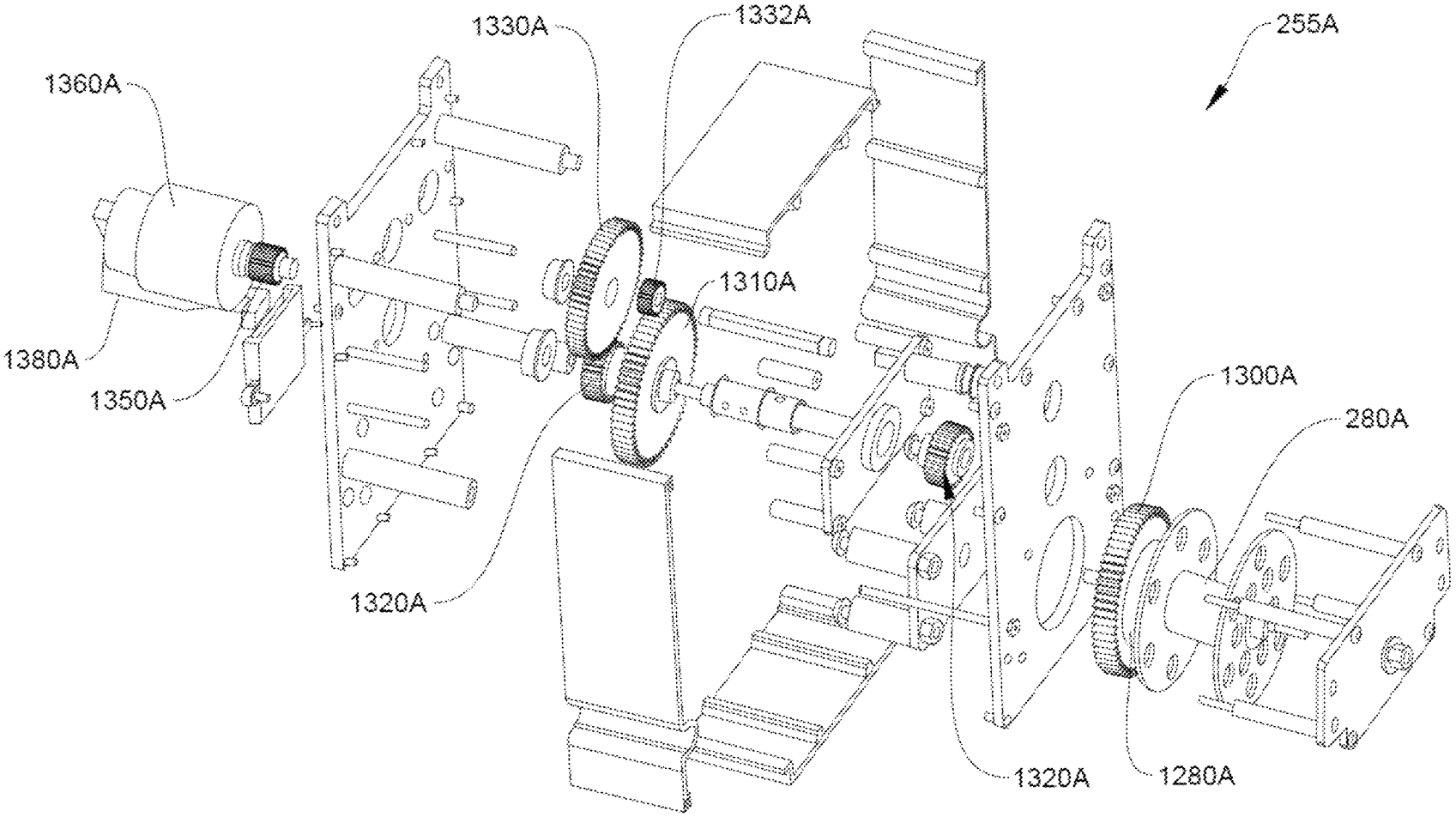
FIG. 3D is an exploded enlarged view of the left motor system, according to one embodiment.

As shown in FIG. 3D, the left pulley system 201A is operably coupled to the left motor system 255A including only one motor 1360A. The left motor system 255A is operably coupled to the left drum pulley 280A, one or more left cable pulleys, and a left drum gear 1280A. The left drum gear 1280A is rotatably coupled to a left spur gear 1300A. The left spur gear 1300A is rotated by a left larger spur gear 1310A. The left larger spur gear 1310A is rotated by a left smaller gear 1320A. The left smaller gear 1320A is rotatably coupled to a left larger gear 1330A and the left larger gear 1330A is rotatably coupled to a left smaller spur gear 1332A. The left larger gear 1330A is rotatably coupled to a second left coupler gear 1350A. The rotation of the first left coupler gear 1340A is driven by a first left motor 1360A only. The left smaller gear 1320A is operably coupled to a left linear actuator 1380A, which switches the left smaller gear 1320A to a higher gear in the isokinetic mode and switches the left smaller gear 1320A to a lower gear in the isotonic mode or calibration mode. The higher gear forces the first left motor 1360A and the second left motor 1370A to achieve a higher force and slower speed on the left cable, while the lower gear forces the first left motor 1360A and the second left motor 1370A to achieve a lower resistive force on the cable allowing for a higher speed of the left cable. In one embodiment, the gear ratio of the lower gear to the higher gear is 1:16, 1:15, 1:14, 1:13, 1:12, 1:11, 1:10, 1:9, 1:8, 1:7, 1:6, 1:5, 1:4, 1;3, 1:2, or 1:1. While one motors are shown with the left motor system 255A, the left motor system 255A may feature any number of modular and interchangeable gear stages when adding additional motors to the left motor system and the left motor system, such as two motors, three motor, four motors, five motors, and the like. Without limitation, the motor systems 255 may further include any number of coupling components required to integrate additional motors and their shaft to the gears with the pulley system 201. The first left motor 1360B and the second left motor 1370B achieve a resistive force of at least about 100 to about 500 lbs. The left linear actuator 1380B is operably controlled by the left linear actuator control board 1390A. The left linear actuator control board 1390B is operably coupled to the machine controller 250.

Figure 4:
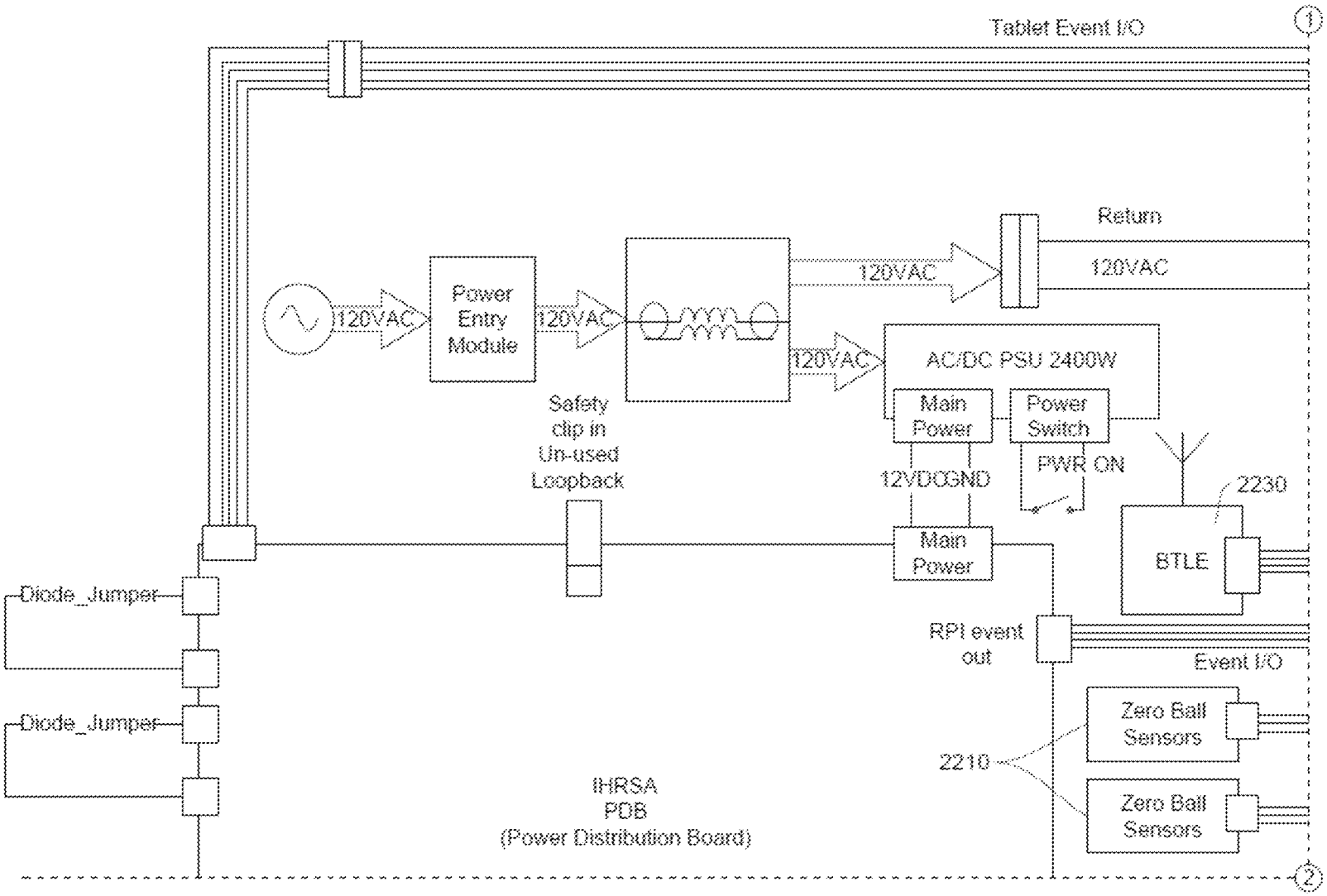
FIG. 4 is a schematic of hardware system for the multi-motor resistance training machine, according to one embodiment.
Figure 4:
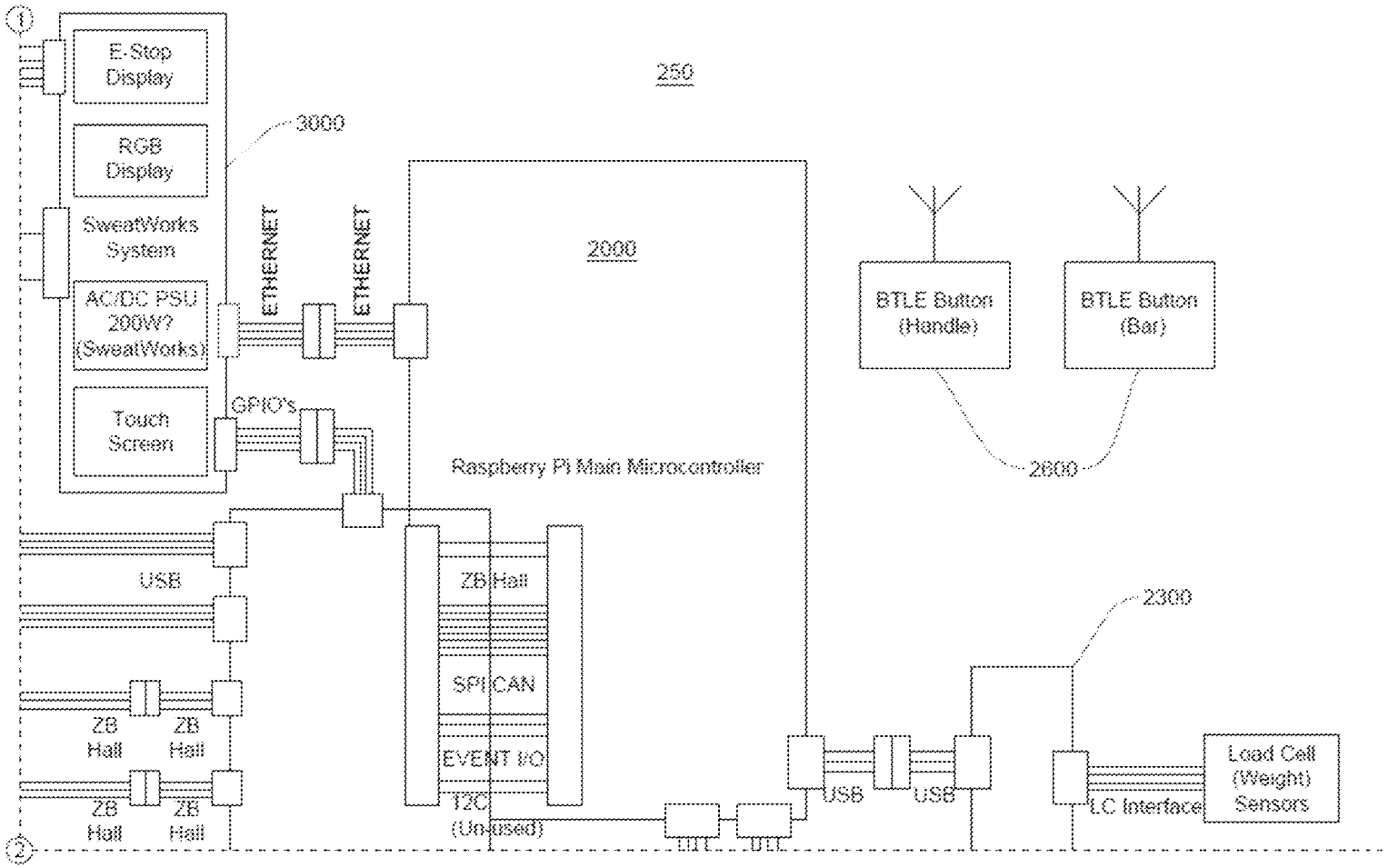
Figure 4:
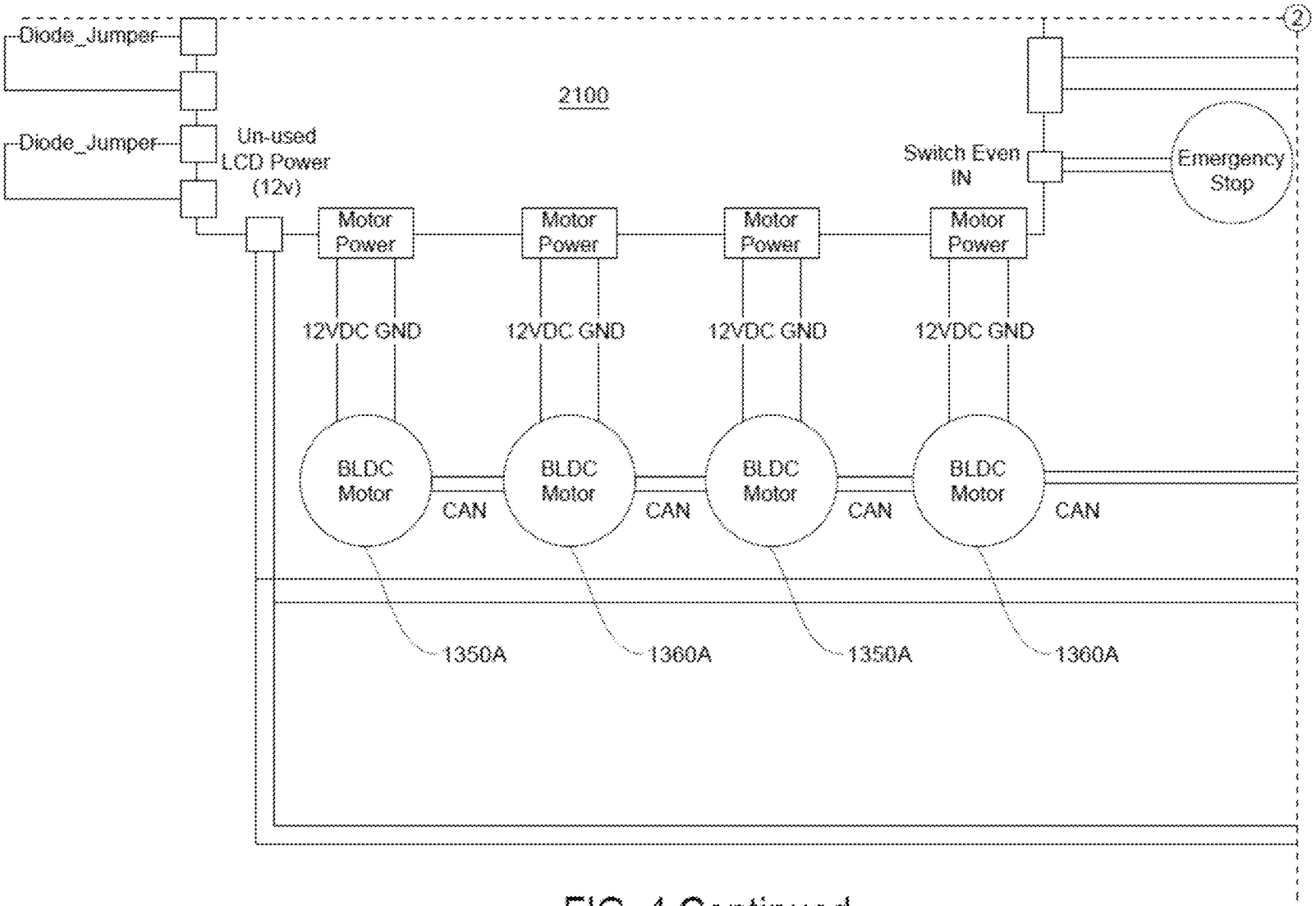
Figure 4:
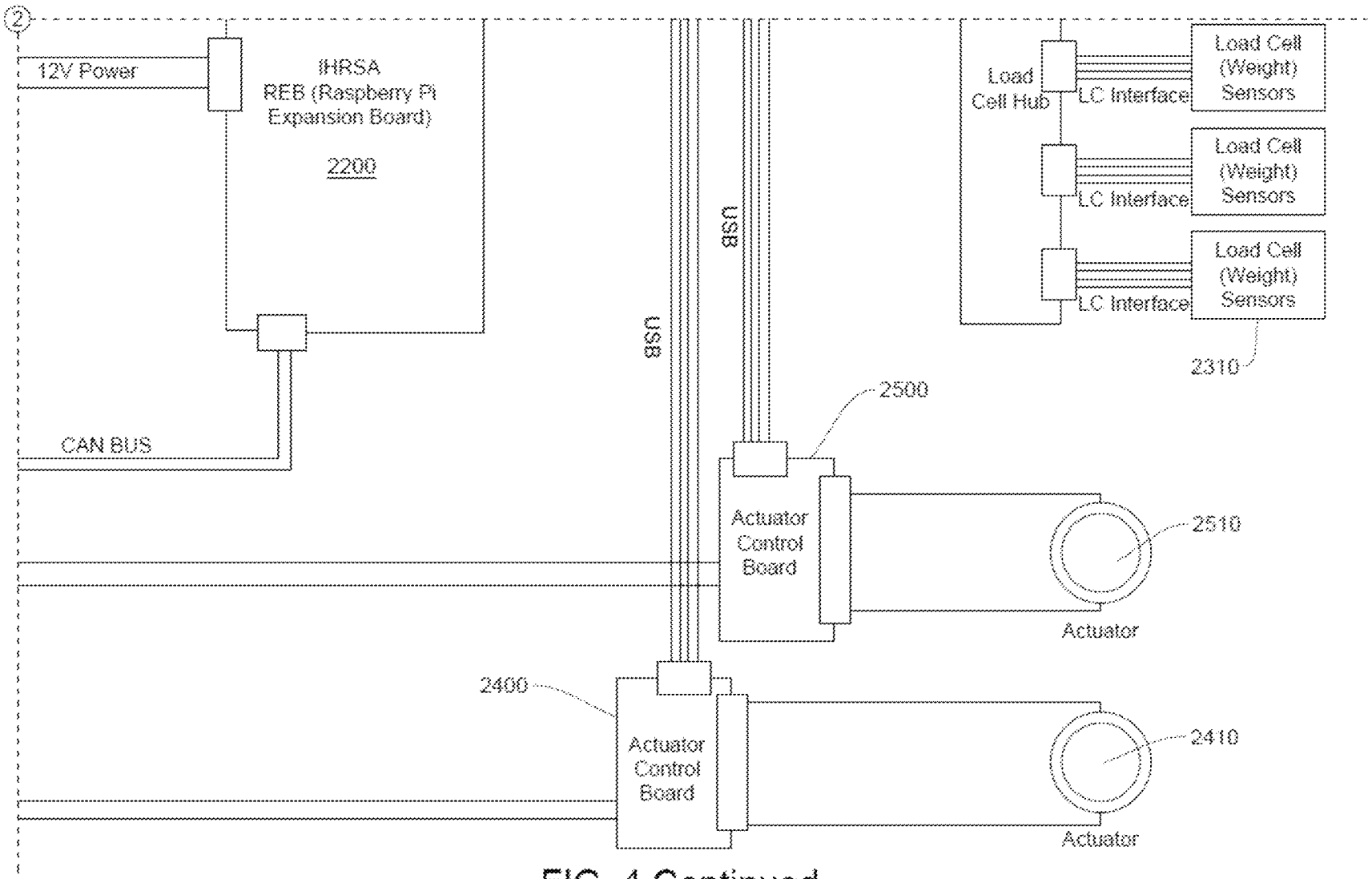

As shown in FIG. 4, the first right motor 1350B, the second right motor 1360B, the first left motor 1350A, and the second left motor 1360B operate under the control of the machine controller 250 comprising a first control system 2000 in operably communication with a power distribution board 2100. The first control system 2000 operably communicates with an expansion board 2200, a load cell hub 2300, a left actuator control board 2400, a right actuator control board 2500, and a wireless button 2400. The expansion board 2200 operably communicates with zero ball sensors 2210 an antenna 2230, a user display operating system 3000, and the power distribution board 2100. The user display operating system 3000 operates the display, touch screen, and User Interface (UI). The first control system 2000 operably communicates with 2300 load cell hub, which controls and receives input from the load cells 2310 in the platform. The right actuator control board 2500 programs the operating modes of the right actuator, and the left actuator control board 2400 programs the operating modes of the left actuator. The wireless button 2600 may signal start/stop functions to the control system 2000 and the wireless button 2600 may operably couple to a handle or bar connected to the left and right cable. The first control system 2000 and the user display operating system 3000 operate under a system software architecture to control and calibrate the resistance training machine.

Figure 5:
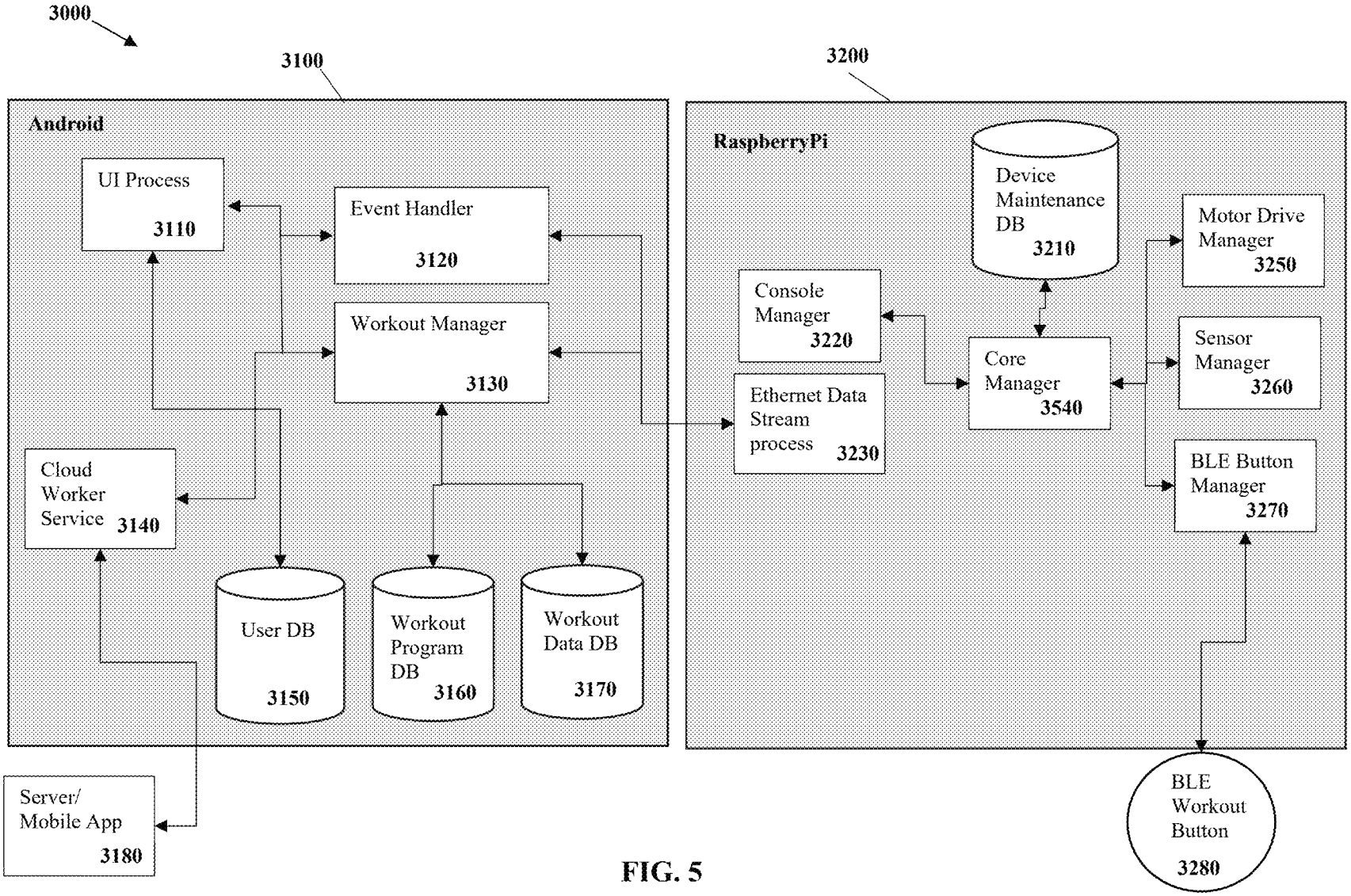
FIG. 5 is a schematic of the software architecture for the multi-motor resistance training machine, according to one embodiment.

As shown in FIG. 5, the system software architecture 3000 comprises a first operating system 3100 and a second operating system 3200, which communicate and send and receive data through an API. In one embodiment, the first operating system 3100 is an Android operating system and the second operating system is a Raspberry Pi operation system, and both employ computer modules to operate commands, events, and streams based upon sent or received data or protocols. The first operating system 3100 and the second operating system 3200 communicate through a messaging structure and a bi-directional communication scheme utilizing MQTT v3.1.1 in order to exchange information between the first and second operating system, with the MQTT broker running on the second operating system 3200, according to one embodiment. The first operating system 3100 includes a UI process 3110, an Event Handler 3120, a Workout manager 3130, a Cloud Worker service 3140, a user database 3150, a Workout program database 3160, a Workout Data database 3170. The UI process 3110 operably communicates and sends/receives data to the Event Handler 3120, the Workout manager 3130, the Cloud Worker service 3140, and the user database 3150. The Workout manager 3130 sends/receives data to the Cloud Worker service 3140 and the Workout program database 3160, and the Workout Data database 3170. The Cloud Worker service 3140 sends and receives data to a server/mobile application 3180.

The second operating system 3200 includes a device maintenance database 3210, a console manager 3220, an Ethernet data/stream process 3230, a core manager 3540, a motor drive manager 3250, a sensor manager 3260, and a wireless button manager 3270. The device maintenance database 3210 sends and receives data from the core manager 3540. The core manager 3540 sends and receives data from the console manager 3220, the motor drive manager 3250, the sensor manager 3260, and the wireless button manager 3270. The Ethernet data stream process 3230 sends and receives data from the event handler 3120 and the workout manager 3130 from the first operating system 3100. The wireless button manager 3270 sends and receives data from the wireless workout button 3280.

The second operating system 3200 sends commands to the first operating system 3100, which are topics for any particular module. The first operating system 3100 populates events that are processed by the second operating system 3200. The second operating system 3200 processes streams, which are topics continuously populated data stream from the first operating system 3100. The first operating system 3100 and the second operating system 3200 process responses for commands or acknowledgements of data, such as errors or critical events. The first operating system 3100 and the second operating system 3200 provide a Calibration of the resistance training machine, which is the procedure of setting min and max values relative to home position for movement and determines the positions between which the movement takes place. The first operating system 3100 and the second operating system 3200 process Movement Data, which is the process of motor rotation in and out to pull in and release cables between defined positions during calibration or loaded from the database. The second operating system 3200 process data relating to Accessories attached resistance training machine, which are devices which are connected to second operating system 3200 using wireless or Bluetooth, to provide UI control movements and calibration of the motor.

Motor Protocol

The modes that the motor system may implement include a Nemesis Mode, a Standard Mode, an Excentric Mode, an Isokinetic Mode, an Isotonic Mode, a Concentric mode, an Eccentric Mode. The Nemesis Mode is the movement mode in which the user is able to do an Isokinetic movement in both directions. The Standard Mode is the movement mode in which the user is able to do an Isotonic movement in both directions. The Excentric Mode is the movement mode in which the user is able to do an Isokinetic movement in the eccentric direction. The Isokinetic mode is Constant velocity movement, where the motor is more powerful than the user. The Isotonic Mode is Constant force movement, where the motor is less powerful than the user. The Concentric mode is the upward portion of a movement. The Eccentric mode is the downward portion of a movement. The modes may be set, calibrated, and executed by motor protocols.

The motor protocol is used for both the left and right motor system and the motor protocol is for receiving data from the second operating system about moving status and moving direction for the motor system. The motor protocol is updated on every change in motor movement or change in motor direction. The motor protocol includes a homed protocol, a command protocol, a response protocol, and an error protocol. The homed protocol contains information about the homing status of a motor and updates on change in the home status. The command protocol is used to send commands to the second operating system. The motor command may include: get relative position to home position and get actual position relative to actual home position. The response protocol contains the response data from the second operating system and response for each command received by the second operating system. The error protocol is used by the first operating system for receiving error data from motors, for example SDK error, parameters set error, a number of errors from list, including motor unexpected stop.

The movement protocol includes a calibration procedure used to establish the movement thresholds to be used during a workout, from where to where the motors will move. The resulting Minimum and Maximum values will be stored by the first operating system and must be passed to the second operating system using a command movement/setMovementData/along with the rest of the movement parameters.

The first operating system sends the communication/movement/calibration/launch Calibration/. The first operating system receives the communication/movement/calibration/calibration Status/. The first operating system sends the/movement/calibration/get Calibration/. The first operating system receives the communication/movement/calibration/actual Calibration/{lmin,lmax . . . }.

The first operating system will receive several/stream/messages from the second operating system during motor movements approximately every 250 ms. The first operating system will receive from the second operating system all/motor/events, plus/accessories/event/. The first operating system may receive the motor protocol for the right and left motor, the stream, or the accessories events.

The get calibration protocol is used for sending a command to the second operating system and receiving actual calibration data. The second operating system may also request actual calibration from the device.

The actual calibration protocol is used for sending actual calibration from the second operating system to the first operating system, and when EM receives command from API.

The actual calibration protocol may send the minimum point in meters relative to home position for left motor, may send the maximum point in meters relative to home position for left motor, may send the minimum point in meters relative to home position for right motor, and may send the maximum point in meters relative to home position for right motor.

If the machine isn't calibrated, then an invalid calibration value is sent to the second operating system.

The set calibration protocol is used to send calibration values from the first operating system to the second operating system. These values set the calibration minimum and maximum for the motors for the subsequent movement. This set calibration protocol should be used for every movement, or the calibration will be in an invalid state. After setting calibration, the second operating system should use the get calibration protocol to get calibration and check for set values.

The launch calibration protocol is used to send command to the second operating system to launch or stop calibration procedure. The status of calibration can be received in the calibration status protocol.

The calibration status protocol is used to receive info from the second operating system about the calibration status. For example, after sending command launch Calibration protocol. The calibration status protocol may include not calibrated, maximum calibration in progress, maximum calibration completed, minimum calibration in progress, minimum calibration completed, and calibration completed The calibration error protocol is used to receive info from the second operating system about calibration error status. For example, after sending command launch calibration protocol.

The set Movement Data protocol is used to set typical movement values. The set movement protocol includes the number of repetitions for movement based on the type of the accessory to process events from the isokinetic, isotonic, eccentric, and mixed modes.

The set movement protocol includes the minimum calibration value for movement in meters for the left side only for isokinetic and mixed modes; the maximum calibration value for movement in meters for the left side only for isokinetic and mixed modes; the minimum calibration value for movement in meters for the right side only for isokinetic and mixed modes; the maximum calibration value for movement in meters for the ride side only for isokinetic and mixed modes; the position for start of movement only for isokinetic and mixed, optionally the top from max point or the bottom for minimum point; which motor is used in movement, optionally left motor system, right motor system, or both motor systems, where calibration uses this value as calibration target; the time for the upward movement; the time for the downward movement only for isokinetic and mixed modes; the force in pounds for the upward movement only for the isotonic mode; the force in pounds for the downward movement only for the isotonic mode.

The movement command protocol is used to send movement commands to the second operating system. To check the status of the movement command protocol, the movement status protocol is used for the response. The movement command protocol includes a start movement, an end movement, a pause movement, and a resume movement.

The movement status protocol is used to receive event status of movement, it also can be a response to the movement command protocol. The movement status protocol is a response and an event, since the movement status can change by both the first and the second operating system (via Bluetooth buttons) interaction. The movement status protocol includes a movement started, a movement paused, a movement resumed, and a movement finished.

The movement error protocol is used by the first operating system to receive an event about movement error. The movement error protocol includes an invalid movement command, a can't start workout due to calibration is not set, an invalid state transition, a hall sensor triggered, and an unable to set movement data.

The movement error acknowledgment is used for sending acknowledge about receiving error from the first operating system to the second operating system.

The sensor status protocol is used to receive events about hall sensor status change. The sensor status protocol includes a status of the left hall sensor, a status of right hall sensor, a status of motor safety circuit and whether it is enabled, or the safety is triggered.

Motor

With continued reference to FIG. 3A, the motors 1350A, 1350B, 1360A, 1360B may be a 'smart' DC brushless motor, including both an integrated motor encoder and an integrated motor controller (not shown). Although four motors are shown, additional motors may be added, such that there may be five motors, six motors, seven motors, eight motors, nine motors, ten motors, and combinations thereof for the left pulley system and the right pulley system. The number of motors selected may be based upon the application and use of the resistance exercise machine.

Moreover, the motors 1350A, 1350B, 1360A, 1360 may be capable of providing independent closed-loop control of a position, speed, acceleration, torque, and current outputted by its shaft. Moreover, the machine controller 250 may be in bi-directional communication with the motor system 255, and both operatively control its operation and receive feedback therefrom. Accordingly, by including an integrated encoder and controller within the motor 255 itself, the resistance training machine 100 may comprise a reduced total number of parts and a reduced total number of electrical connections, and may further improve a manufacturing efficiency, machine reliability, machine reparability, and overall cost.

In addition to the foregoing, the motor 1350A, 1350B, 1360A, 1360B may be configured with a number of specific control features. According to an embodiment, the motor system 255 may be capable of independently implementing closed-loop PID feedback; and/or may be capable of independently operating at a constant current, operating at a constant position, operating at a constant velocity, and/or implementing a specific motion profile. In the same or other embodiments, the machine controller 250 may operatively supply instructions to the motor system 255 with respect to the above parameters through a CAN bus, PWM signal, or similar protocol common to the art.

For example, the machine controller 250 may command the motor system 255 to operate at a specific velocity, e.g., in order to provide an isokinetic exercise to a user exercising with the machine 100. Upon receiving such a command, the motor 255 may be capable of independently maintaining the commanded velocity through internal control mechanisms without the need for additional signals from the machine controller 250 or from external encoders (not shown). The above notwithstanding, in some embodiments, the motor system 255 may also receive external feedback from the machine controller 250 and/or from external encoders to supplement its internal control mechanisms.

In another embodiment, the machine controller 250 may command the motor systems 255 to operate at a specific current or torque, e.g., in order to provide an isotonic exercise to the exercising user. Likewise, the motor system 255 may be capable of independently maintaining the necessary current or torque through internal control mechanisms without the need for external data, feedback, or commands. It may be appreciated that, with regard to isotonic exercises in particular, the machine controller 100 may be configured to convert a desired force level in the cable 140 to a current or torque level of the motor system 255. In such circumstances, the machine controller 250 may be configured to consider any number of system factors, such as but not limited to force multipliers in the pulley system 201, transfer functions in the motor system 255, and the like.

According to some embodiments, the motor 255 may be configured to implement a specific motion profile received from the machine controller 100, which may or may not be 'streamed' in real time. For example, the motor 255 may be configured to ramp up to or ramp down from a given velocity, e.g. during an initial or ending phase of an isokinetic exercise; or the motor system 255 may be configured to ramp up to or ramp down from a given force, torque, or current, e.g. during an initial or ending phase of an isotonic exercise. In the same or other embodiments, the motor 255 may be configured to implement independent S-curve smoothing; and/or may be configured to operate at constant accelerations, operate within minimum and/or maximum velocities, operate within minimum and/or maximum accelerations, and yet other kinematic controls, which further improve a perceived smoothness and overall safety for the user.

Furthermore, in some embodiments, one or both of the left motor system 255A and the right motor system 255B may be capable of implementing a 'follow mode' protocol, wherein a 'follower' motor may be controlled by and execute an identical motion profile to a 'lead' motor, e.g., during symmetrical exercises.

The specifications for an exemplary motor 255 to be used in conjunction with the resistance training machine 100 are now provided. In the table shown, the motor 255 may specifically be a Falcon 500 motor, developed and sold by Innovation First, Inc.©. The exemplary motor 255 may have a nominal voltage between 8V and 16V, and preferably between 10V and 14V; a stall torque between 3 Nm and 6 Nm, and preferably between 4 Nm and 5 Nm; a peak power rating between 600W and 100W, and preferably between 750W and 850W; and a volume between 100 $cm^3$ and 300 $cm^3$, and preferably under 250 $cm^3$. As discussed above, each of the left motor 255A and the right motor 255B may be functionally identical and may accordingly share the above characteristics.

Machine Controller

Returning to FIG. 3A, the machine controller 250 will now be discussed in greater detail. The machine controller 250 may be, without limitation, a microcontroller, gateway computer, field-programmable gate array (FPGA), application-specific integrated-circuit (ASIC), or comparable computing device configured to interface with at least the motors 255, the load cells 299, and the HMI 110. The machine controller 250 may receive electrical power from the power supply 235 and may comprise at least a processor, a memory in the form of a non-transitory storage medium, and a communication bus (not shown).

As previously discussed, the machine controller 250 may be in bi-directional communication with each of the motors 255. More specifically, it may command an operation of each motor 255 through a CAN bus, PWM signals, or comparable communication protocol, and may receive feedback from each motor 255 via the same or additional communication channels. For example, the machine controller 250 may command each motor 255 to operate at a specific velocity, specific torque or current level, or specific motion profile, depending on the exercise being provided for the user. In some embodiments, after supplying the initial command to the motor 255, the machine controller 250 may not be required to participate in the motor's 255 independent control processes. For example, the machine controller 250 may supply the initial command for a concentric motion of an exercise, defer to the motor's independent closed-loop control, and then, upon completion of the concentric motion, supply the command for the eccentric motion of the same exercise. And in other embodiments, the entire repetition or even the entire set of repetitions may be independently controlled by each motor 255. However, it may be appreciated that the control scheme between the machine controller 250 and each motor 255 may differ depending on the exercise being performed, wherein each exercise may be left-side only, right-side only, symmetric, functionally symmetric, etc. For example, where a symmetric exercise is provided, the machine controller 250 may provide commands to the 'lead' motor 255 only, which may then be replicated by the 'follower' without direct input from the machine controller 250.

In addition to controlling an operation of the motors 255, the machine controller 250 may also receive feedback therefrom, including at least a position feedback and a current, torque, and/or force feedback. In an embodiment, the position feedback may be supplied by the integrated motor encoder, and the current, torque, and/or force feedback may be supplied by the integrated motor controller. In some embodiments, each motor 255 may only supply a position feedback and a current feedback, wherein the latter may be converted into the relevant parameter, e.g. force, by the machine controller 255, after accounting for force multipliers in the pulley system 201, transfer functions in the motor 255, and the like. In the same or other embodiments, additional metrics may be monitored by the machine controller 250, such as not limited to the temperature levels, voltage levels, power consumption, and efficiency of each motor 255.

Furthermore, the machine controller 250 may implement algorithms and/or software processes which perform an analysis on the data received from the motors 255 to provide user form feedback and user balance feedback on some or all exercises performed on the resistance training machine 100. Such analysis may consider, without limitation, the type of exercise being performed, the mode of the exercise (e.g. isokinetic or isotonic), the specified velocity or force levels outputted by the motors 255, the number of repetitions, the motion profile executed by the motor 255, and yet other factors; and may further depend on a sampling frequency of the motor 255 and/or the machine controller 250. For example, during an isokinetic and isometric exercise, the machine controller 250 may utilize the position feedback from the motors 255 to determine a kinematic motion of the user throughout his or her range of motion. Likewise, during an isotonic and isometric exercise, the machine controller 25 may utilize the current feedback from the motors 255 to determine a force applied by the user throughout his or her entire range of motion. In the above examples, it may be determined that the user's physical motion or force output is sufficiently balanced between the left and right sides of the body, or alternatively, that an unbalanced distribution has occurred. Such analysis by the machine controller 250 may then be communicated to the user through the HMI 110 and/or, in some circumstances, may lead to the activation of certain safety protocols. No limitation is intended herein for the type and number of user form and user balance metrics which may be derived by the machine controller 250, nor for the algorithms and mechanisms by which feedback is extracted from the motors 255 and the subsequent analysis performed.

With continued reference to FIG. 4, the machine controller 250 may also be in operative communication with the one or more load cells 299. Accordingly, the force data from each load cell 299 may be analyzed independently or in conjunction with the data from the motors 255 to further extract feedback on user form and user balance. For example, given a specific force distribution among the load cells 299, it may be determined that a user's stance is irregular, that a user's stance is unbalanced with respect to the left-side or right-side of the body, that a user's stance is fluctuating too erratically, that a user is standing unacceptably close to an edge of the platform 102, etc. In any case, such feedback may be communicated to the user through the HMI 110 and/or may be used to engage safety protocols if certain tolerances are exceeded.

In the above or other embodiments, the force feedback from the load cells 299 may be consolidated with feedback from the motors 255 to provide more complex insights into user form and user balance. For example, net force data from the load cells 299 may be measured against a net force outputted by the motors 255. The comparison therein may be used to calculate a distribution of vertical (Z-axis) and horizontal (X-axis, Y-axis) force vectors, thereby arriving at a simulated pulling angle of one or both cables 140. It should be understood, however, that each of the above analyses are exemplary only, and that no limitation is intended herein for the methods or algorithms by which data from the motors 255 and the load cells 299 are measured and analyzed to drive insights for the user.

HMI

Returning now to FIG. 1, the HMI 110 may further include at least a display 111 and an input mechanism. The display 111 may include, without limitation, an electroluminescent (ELD) display, LCD monitor, LED monitor, OLED monitor, QLED monitor, touchscreen, and/or other technologies common to the art. In some embodiments, such as the one shown in FIG. 10, the HMI 110 may further include one or more speakers. The input mechanism may be in the form of a touch screen, analog or digital buttons, analog or digital dials and knobs, computer mouse, touchpad, microphone, and/or other technologies common to the art. It may be understood that, depending on the embodiment, the machine controller 250 may include additional infrastructure necessary to interoperate with the components of the HMI 110.

In some embodiments, the machine controller 250 may further implement software to generate a graphic user interface (GUI) displayed by HMI 110. The GUI may be configured to receive a user's selection of exercise type, exercise mode, exercise velocity, exercise force, exercise repetitions etc. Furthermore, the GUI may display feedback regarding the user's form and balance, and/or the GUI may alert the user when unsafe practice are detected. For example, during an ongoing exercise, a visual representation on the HMI 10 may display a simulated user form, a relative position of the cable, a force distribution between the left and right sides of the user's body, a weight distribution across the platform 102, a simulated user stance, and yet other possibilities. Indeed, no limitation is intended herein for the means by which the HMI 110 may receive selections from the user, nor for the means by which feedback on user balance and form may be displayed on the HMI 110.

While the above has described a number of electronic components comprising the resistance training machine 100, several hardware features will now be discussed in greater detail.

Accessories

More specifically, the resistance training machine 100 may comprise a number of hardware features which improve its ease of use and its customizability. In the embodiment shown in FIG. 1, the machine 100 may include a safety pedal connected to the platform 102, which provides an emergency stop to the user that may be pressed by a foot or hand. The machine may include at least two wheels 230 located on the platform 102, enabling the machine 100 to be transported over short distances. In some embodiments, the resistance training machine 100 may be self-contained, i.e., may not require any installation with external infrastructure, and may be transportable without attachment or detachment from the floor or walls of a room. In other embodiments, however, the machine 100 may further benefit from external installation, such as through mechanisms (not shown) locking the platform 102 onto the floor or mechanisms mounting the front upright stand 115 against a wall.

Returning now to FIG. 1, the resistance training machine 100 may further comprise a removable bench situated on top of the platform 102. In various embodiments, the bench may be fully detached from the platform 102, or the bench may include one or more locking mechanism (not shown) securing it to the platform 102. The machine 100 may further comprise any number of loose accessories, such as the triangle handle and the straight bar, which may be attached to the left cable 140A and/or the right cable 140B. The accessories may include both dual-cable attachments and single-cable attachments, such as but not limited to curl bars, double handlebars, lat pulldown bars, V-bars, hammer ropes, chinning triangles, close-grip bars, and many others. As previously discussed, in some embodiments, each cable 140 may also terminate in a carabiner, D-ring, or similar locking device to interlock with the various attachments provided.

With continued reference to FIG. 1, the machine 100 may also comprise a front upright stand attached to the front of the platform 102 and oriented substantially vertical to the platform 102 and the floor. In the embodiment shown, the HMI 110 may be located on the front upright stand, and its electrical connections may be wired through one or more upright supports 120. Accordingly, a user of the resistance training machine 100 may perform a workout while standing atop the platform 102, holding the left and/or right cables 140, and entering selections and receiving feedback through the HMI 110. In the same or other embodiments, an accessory rack (not shown) may be attached to the front upright stand 115, and may include shelves, hooks, bar holders, trays, and other features common to the art. In another embodiment of the resistance training machine 100, the HMI 110 may still be located on the front upright stand 115, which is attached to and supported by the EM assembly 103. Returning now to FIG. 1, in yet further embodiments, one or more adjustable workout pulleys (not shown) may be operatively attached to the front upright stand (115). For example, the front upright stand 115 may feature one or more vertically-oriented pulley frames (not shown), whereupon the workout pulleys may be attached to the pulley frame and slidably raised or lowered with a locking mechanism. Furthermore, each cable 140 may extend from the pulley housing 205 and run through one or more workout pulleys, which further change a direction of movement and force of the cable 140, thereby enabling yet additional exercises which can be performed on the resistance training machine 100. It may be appreciated that, regardless of the exercise being performed, all force vectors ultimately terminate on the platform 102 and are transferred into the floor, a configuration which may enable larger weights to be safely handled by the machine 100. Indeed, in some embodiments, a combination of the left cable 255A and right cable 255B may be capable of exerting upwards of 800 to 1000 pounds of resistance during a workout.

Custom Workouts

Figure 6:
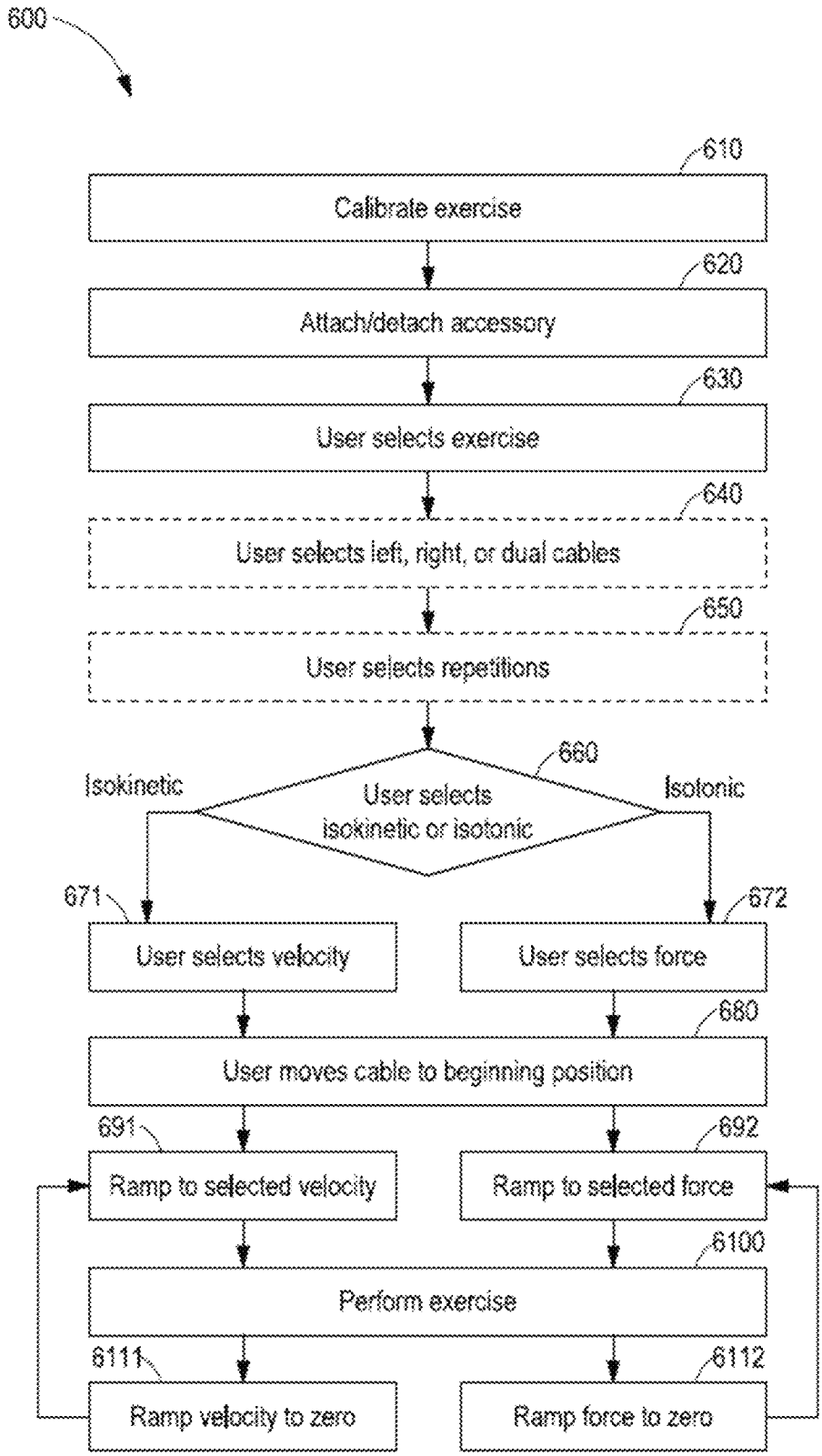
FIG. 6 is a flowchart outlining a method of providing custom workouts using the resistance machine according to one embodiment.

As shown in FIG. 6, a method of providing custom workouts using the disclosed resistance training machine is generally referred to by a reference numeral 600. The method may comprise first calibrating one or more exercises (block 610), each exercise having a relative beginning position and a relative end position. More specifically, the user may program the relative beginning position by extending or retracting one or both cables to a first position, without resistance, and holding the first position for 2-5 seconds. The user may then program the relative end position by extending or retracting one or both cables to a second position, without resistance, and holding the second position for 2-5 seconds. In some embodiments, it may be understood that the 'relative' beginning and 'relative' end positions may be used merely to define a length of travel for the cable. For example, various exercises may be started from any cable position, and the difference between the calibrated beginning and end positions may be used to determine a length of travel until the end position of the exercise. It may further be appreciated that some or all exercises may require calibration of only one of or both of the left and right cables.

In some embodiments, the machine and, more specifically, the machine controller, may be programmed to include a Calibration Mode incorporating the above steps, where said steps may be facilitated through the display and input mechanism of the HMI. In the same or other embodiments, recalibration of an exercise may be performed at any time by entering the Calibration Mode.

With continued reference to FIG. 6, in block 620, the user may optionally attach or detach an accessory to one or both cables. Next, the user may select an exercise from among the one or more calibrated exercises (block 630). In various embodiments, the user may further select to perform the exercise using the left cable only, the right cable only, or using both the left and right cables (640); the user may select a number of repetitions for the exercise (block 650); and/or the user may select an exercise mode, such as an isokinetic mode or an isotonic mode (block 660). If an isokinetic mode is selected, the user may further select a constant velocity to be outputted by the machine (block 671); or, if an isotonic mode is selected, the user may further select a constant force to be outputted by the machine (block 672).

It may be understood, however, that different exercises may require only one or both cables, or may even be performed with functional symmetry, i.e. alternating left and right cables; that different exercises may require a specific number or range of repetitions; that different exercises may be performed in a specific exercise mode only; that different exercises may require a specific number or range of velocity and force; and/or that different exercises may be preprogrammed into the machine. Indeed, no limitation is intended herein for the specific combination of exercise type, handedness, symmetry, repetitions, exercise mode, and/or range of exertions that may be provided by the machine. Furthermore, it should be understood that some or all of the above steps may be obviated, may be performed in a different order, and/or may be performed concurrently, without departing from the scope of the present disclosure. In some embodiments, the machine and, more specifically, the machine controller may be programmed to include a Ready Workout Mode incorporating the above selection steps, where said steps may be facilitated through the display and input mechanism of the HMI.

With continued reference to FIG. 6, after an exercise and its parameters are selected, the user may then begin the exercise and move the cable to a beginning position, without resistance from the motors (block 680). More specifically, the user may enter a GO command into the HMI, after which a period of time is allocated for the user to freely move the cable to the desired beginning position, such as between about 1 and about 10 seconds and, more preferably, between 4 and 6 seconds. As previously discussed, this beginning position may then be used by the machine controller to define the end position of the exercise, based on the difference between the relative beginning and the relative end that was calibrated for the exercise.

Next, the motor may ramp up the cable to a constant velocity (block 691), e.g., for an isokinetic exercise, or ramp up the cable to a constant force (block 692), e.g., for an isotonic exercise. The user may then perform a repetition of the exercise (6100) at the constant velocity or force. Near the end position of the motion, the motor may ramp down the cable from the constant velocity to zero or a minimum velocity (block 6111), e.g., for the isokinetic exercise; or ramp down the cable from the constant force to zero or a minimum force (block 6112), e.g., for an isotonic exercise. Finally, blocks 691-6111 may be repeated for a selected number of repetitions, and the workout completed. In various embodiments, specific ramp up and ramp down times may be selected by the user, set by the manufacturer, and/or changed according to the associated exercise; and may be set to between 0.5 and 3 seconds, and more preferably, between 1 and 2 seconds. Furthermore, additional smoothing, such as S-curve smoothing, may be applied to the motion profile of the cable during either ramp up or ramp down procedures.

In some embodiments, the machine may feature a Pull-in Slack mode that is designed to retract the cables when no longer in use. Accordingly, the method 600 may include the motor retracting the cable to the docking position at a minimum force or minimum velocity if/when certain conditions are met. According to an embodiment, the Pull-In Slack mode may be activated if/when the cable is not in the docking position and no resistance has been detected by the machine controller for between 5 and 15 seconds and, more preferably, between 8 and 12 seconds. In the same or other embodiments, the Pull-in Slack Mode may be deactivated (and the retraction ceased) if, during retraction, a resistance is detected in the cables. It may be understood that Pull-in Slack mode may also be activated in other circumstances and may be activated for a single cable at a time or both cables concurrently.

In some embodiments, the machine may further feature any number of safety protocols designed to protect the user and/or the machine when dangerous activity is detected or when certain limits are exceeded. In such embodiments, the machine may enter a Non-workout Mode, wherein no resistance is exerted by one or both motors. In the same or other embodiments, the Non-workout Mode may be followed by the Pull-in Slack Mode in order to reset the machine. For example, the machine may enter the Non-workout Mode if, in the course of an exercise: a force exceeding between 300 and 700 pounds or, more preferably, 500 pounds is exerted on either motor; a repetition exceeds between 6 and 14 seconds or, more preferably, 10 seconds; or either or both knobs are within between 0.5 and 2 inches or, more preferably 1 inch of the docking position. In such circumstances, the motor may cease providing resistance, followed by a brief pause, and then begin retraction through the Pull-in Slack mode. As discussed above, the machine may further utilize the load cells to enable additional safety protocols, in combination with or independent of the above conditions. For example, the Non-workout Mode may be activated if the cable is not in the docking position and one or more load cells detect an unsafe user balance, or if the user is standing too close to an edge of the base.

Furthermore, in some or all of the above embodiments, a corresponding status or alert may be communicated to the user through the HMI, informing the user of the type, cause, and/or remedy to an encountered problem. It should be understood that the above conditions and protocols are exemplary only, that other conditions or sets of conditions may be programmed to activate the Non-workout Mode, that periods of time other than the above may be necessary or sufficient to activate the Non-workout Mode, and that other procedures may be activated by the machine as part of various safety protocols without departing from the scope of the present disclosure.

Figure 7:
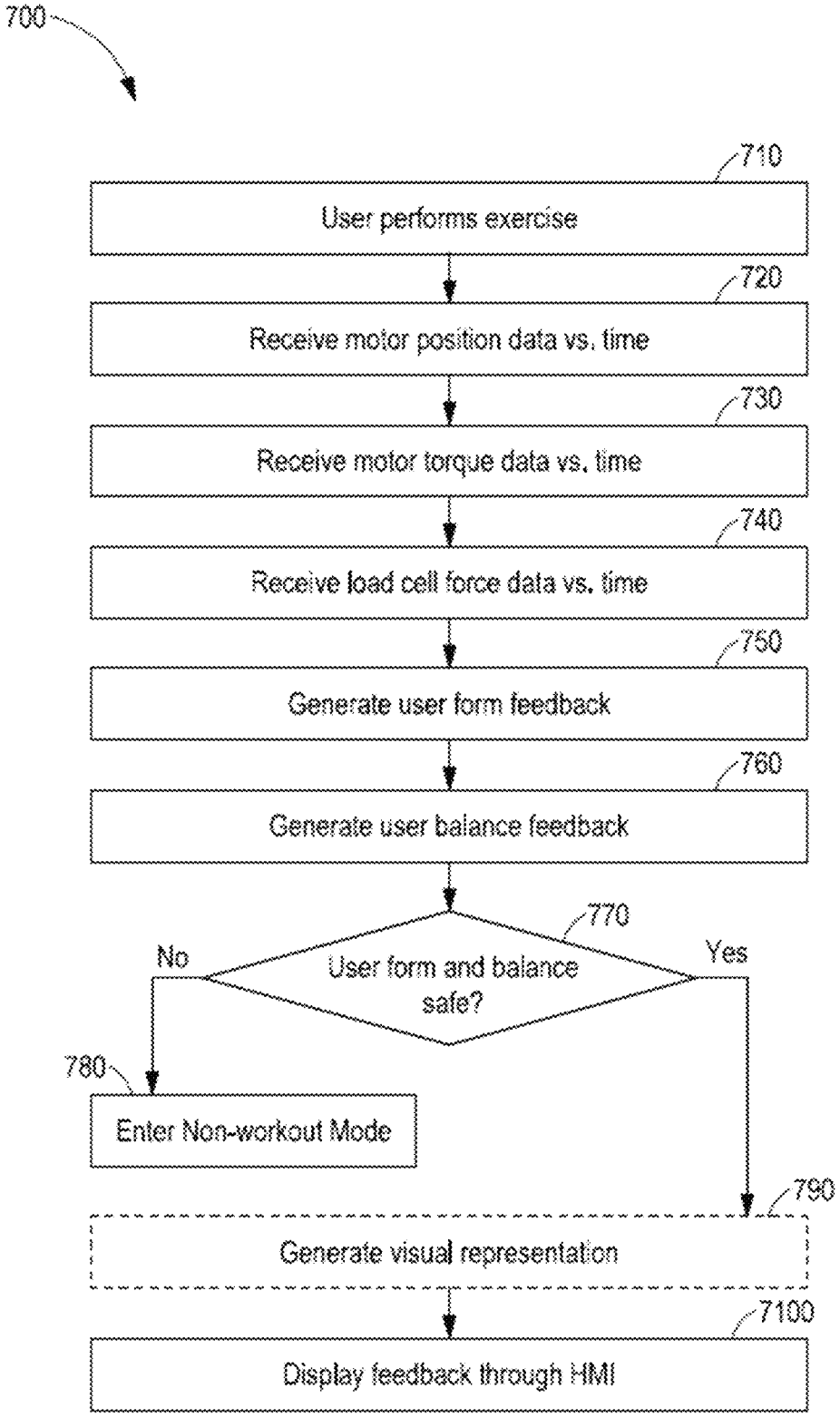
FIG. 7 is a flowchart outlining a method of providing feedback on user form and user balance during an exercise on the resistance training machine according to one embodiment.

Turning now to FIG. 7, a method of providing feedback on user form and user balance while exercising on the resistance training machine is generally referred to by a reference numeral 700. As seen in FIG. 7, the method may first comprise a user performing an isokinetic exercise or an isotonic exercise using resistances supplied by the motors of the machine (block 710). During the exercise, the machine controller may receive position data as a function of time from the motor (block 720), and the machine controller may receive current, torque, and/or force data as a function of time from the motor (block 730). In an embodiment, the machine controller may further receive force data, weight data, force distribution data and/or weight distribution from the load cells (block 740).

Next, in block 750, the machine may generate feedback pertaining to the user's form from some or all of the above data received by the motors and the load cells; and, in block 760, the machine may generate feedback pertaining to the user's balance from some or all of the above. As previously discussed, no limitation is intended herein for the algorithms or strategies by which insights may be extracted from the underlying data. Finally, the machine may display the user form and user balance feedback through the HMI through any number of means known in the art, such as but not limited to a GUI, graphs, charts, tables, simulations, audio cues, and the like (block 7100). In some embodiments, the machine controller may specifically generate a visual representation of the user's form and balance (block 790), such as but not limited to a 3D model, a color-coded display of active muscle groups, a distribution of left-side and right-side forces, and many other possibilities, which may improve a comprehension and/or enjoyment for the user.

In some embodiments, the above feedback information may also be used to activate safety protocols. As seen in block 780, if unsafe user activity is detected, the machine may enter a Non-workout Mode, wherein the motors may cease to apply resistance. In the same or other embodiments, appropriate alerts, such as visual or audio cues, may further be communicated to the user through the HMI 10. However, it should be understood that other safety triggers and other resulting actions are also possible and envisioned.

System

As used in this application, the terms "component" and "system" are intended to refer to a computer-related entity, either hardware, a combination of hardware and software, software, or software in execution. For example, a component can be, but is not limited to being, a process running on a processor, a processor, an object, an executable, a thread of execution, a program, and/or a computer. By way of illustration, both an application running on a server and the server can be a component. One or more components can reside within a process and/or thread of execution, and a component can be localized on one computer and/or distributed between two or more computers.

Generally, program modules or protocols include routines, programs, components, data structures, etc., that perform particular tasks or implement particular abstract data types. Moreover, those skilled in the art will appreciate that the inventive methods can be practiced with other computer system configurations, including single-processor or multiprocessor computer systems, minicomputers, mainframe computers, as well as personal computers, hand-held computing devices, microprocessor-based or programmable consumer electronics, and the like, each of which can be operatively coupled to one or more associated devices.

The illustrated aspects of the innovation may also be practiced in distributed computing environments where certain tasks are performed by remote processing devices that are linked through a communications network. In a distributed computing environment, program modules can be located in both local and remote memory storage devices.

A computer typically includes a variety of computer-readable media. Computer-readable media can be any available media that can be accessed by the computer and includes both volatile and nonvolatile media, removable and non-removable media. By way of example, and not limitation, computer-readable media can comprise computer storage media and communication media. Computer storage media includes volatile and nonvolatile, removable and non-removable media implemented in any method or technology for storage of information such as computer-readable instructions, data structures, program modules or other data. Computer storage media includes, but is not limited to, RAM, ROM, EEPROM, flash memory or other memory technology, CD-ROM, digital versatile disk (DVD) or other optical disk storage, magnetic cassettes, magnetic tape, magnetic disk storage or other magnetic storage devices, or any other medium which can be used to store the desired information and which can be accessed by the computer.

Communication media typically embodies computer-readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer-readable media.

Software includes applications, protocols, and algorithms. Software may be implemented in a smart phone, tablet, or personal computer, in the cloud, on a wearable device, or other computing or processing device. Software may include logs, journals, tables, games, recordings, communications, SMS messages, Web sites, charts, interactive tools, social networks, VOIP (Voice Over Internet Protocol), e-Mails, and Videos.

In some embodiments, some or all of the functions or process(es) described herein and performed by a computer program that is formed from computer readable program code and that is embodied in a computer readable medium. The phrase "computer readable program code" includes any type of computer code, including source code, object code, executable code, firmware, software, etc. The phrase "computer readable medium" includes any type of medium capable of being accessed by a computer, such as read only memory (ROM), random access memory (RAM), a hard disk drive, a compact disc (CD), a digital video disc (DVD), or any other type of memory.

All publications and patent applications mentioned in this specification are herein incorporated by reference to the same extent as if each individual publication or patent application was specifically and individually indicated to be incorporated by reference.

While the invention has been described in connection with various embodiments, it will be understood that the invention is capable of further modifications. This application is intended to cover any variations, uses or adaptations of the invention following, in general, the principles of the invention, and including such departures from the present disclosure as, within the known and customary practice within the art to which the invention pertains.

What is claimed is:

1. A multi-motor resistance training and a motor system module for an exercise machine, comprising: a training program module and a programming framework;

wherein a motor system module sets a mode of a drive system in an isokinetic mode at varying velocity levels and/or a isotonic mode at varying force levels; the motor system module sets and removes the force for both a right and a left motor systems and operates a first motor in a left drive system and a second motor in a right motor system in parallel; the motor system module sets and removes a target velocity for the right and left motor system; and upon receiving a command to set and remove the target velocity, the motor system module independently maintains the commanded velocity through internal control mechanisms without the need for additional signals from a machine controller or from external encoders, wherein each of the left motor system and the right motor system further includes an actuator, and the motor system module shifts the left motor system and the right motor system to a lower gear from a higher gear, and from the higher gear to the lower gear; wherein the training program module removes a break/stop of the motor system and sets proper actuator position; the training program module sends a start calibration mode or sets a movement data from a previous calibration, where the motor system module tracks an encoder and not allow a user to pull out more cable by placing the brake at the proper max/min; wherein if calibration is needed, the motor drive module looks for a tension on the cables and if the user is resisting the cable, the drive system should stop pulling the cable in; and the user then presses a sensor once it is in a right stop; wherein the motor system module sets and checks a target distance for each repetition on the exercise machine; the motor system module receives the data from a motor sensor or a wireless sensors; data from each of the first motor and the second motor is collected, stored, and sent upon request from the motor system module; the programming framework is operably coupled and communicable to a motor hardware and a socket Controller Area Network (CAN); the programming framework controls the motor hardware contained in the drive system by a Proportional-Integral-Derivative (PID) controller; the motor hardware is operably coupled to the actuator to shift the drive system from a lower gear to a higher gear; wherein, the lower gear is between 1.6:1 and 4.8:1 and the higher gear is between 22:1 to 66:1; and the isokinetic mode sets the drive system to the higher gear and the isotonic mode sets the drive system to the lower gear.

2. The motor system module of claim 1, wherein the socket CAN is an implementation of (Controller Area Network) CAN protocols; the CAN socket includes an Application Programming Interface (API).

3. The motor system module of claim 2, wherein programming framework comprises the Proportional-Integral-Derivative (PID) controller that independently tunes the drive system to operate at a constant current, operate at a constant position, operate at a constant velocity, or implement a specific motion profile; the motor system module moves the cable and provides tension by a control loop; the motor system module may apply a stop value, a start value, apply current value or a speed value, depending on isotonic or isokinetic mode applied; the PID values instructions the motor on how smooth the motor pulls the cable and how much current is applied to the motor to pull the cable or provide tension on the cable or a counter force; the motor system module operatively supplies instructions to the drive system through a CAN bus, pulse width modulation (PWM) signal;

when the exercise machine is off, the motor system module applies a brake or stop value to the right and left motor systems.

4. The motor system module of claim 3, wherein the Proportional-Integral-Derivative (PID) controller continuously calculates an error value e(t) as the difference between a desired setpoint (SP) and a measured process variable (PV) and applies a correction based on a proportional term, an integral term, and a derivative term; wherein the PID controller automatically applies an accurate and responsive correction to a control function; the PID controller includes an algorithm that restores the measured speed to the desired speed with minimal delay and overshoot by increasing the current output of the motor in a controlled manner; and the PID controller updates all closed-loop modes every 1 ms.

5. The motor system module of claim 4, wherein the difference between the PV and SP is the error (e), which quantifies whether the current value or speed value is too low or too high and by how much; the input to the process and the electric current in the motor is the output from the PID controller, and is either a manipulated variable (MV) or a control variable (CV); measuring the position (PV), and subtracting it from the setpoint (SP), the error (e) is found, and from it the controller calculates how much electric current to supply to the motor (MV).

6. The motor system module of claim 5, wherein the PID controller includes a plurality of parameters Kp, Ki, Kd that are manipulated to produce various response Curves from a given process; the constant Kp, Ki, Kd values are set by using a resistor and a capacitor or a microcontroller, which integrates large amounts of code in a single IC; the Kp, Ki, Kd values are tuned for the isotonic and the isokinetic modes; while tuning the closed-loop, a tuner configuration changes the gains between 0.001 seconds and 0.1 seconds; once the PID loop is stable, the gain values are set in the code.

7. The motor system module of claim 6, wherein the PID controller pull closed-loop gain/setting information from a selected slot, wherein the selected slots includes four slots to choose from for gain-scheduling, kF, kP, KI, and kD; the PID controller loop is used for a velocity closed-loop, a current closed-loop, or a Velocity Feed Forward gain (kF); wherein the kF is the Feed Fwd gain for Closed loop, the kP is the Proportional gain for closed loop, and is multiplied by closed loop error in sensor units, the kI is the Integral gain for closed loop, which is multiplied by closed loop error in sensor units every PID Loop, and the kD is the Derivative gain for closed loop, and is multiplied by a derivative error (sensor units per PID loop).

* * * * *